US008102343B2

(12) United States Patent
Yatabe

(10) Patent No.: US 8,102,343 B2
(45) Date of Patent: Jan. 24, 2012

(54) LIQUID CRYSTAL DEVICE, DRIVING CIRCUIT FOR LIQUID CRYSTAL DEVICE, METHOD OF DRIVING LIQUID CRYSTAL DEVICE, AND ELECTRONIC APPARATUS

(75) Inventor: Satoshi Yatabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1001 days.

(21) Appl. No.: 12/039,299

(22) Filed: Feb. 28, 2008

(65) Prior Publication Data

US 2008/0238842 A1 Oct. 2, 2008

(30) Foreign Application Priority Data

Mar. 30, 2007 (JP) ..... 2007-093098

(51) Int. Cl.
*G09G 3/36* (2006.01)

(52) U.S. Cl. ..... 345/89; 345/96

(58) Field of Classification Search ..... 345/87
See application file for complete search history.

(56) References Cited

U.S. PATENT DOCUMENTS 7,760,179 B2 * 7/2010 Lee ..... 345/98

FOREIGN PATENT DOCUMENTS

JP A-09-198012 7/1997
JP A-2003-302942 10/2003

* cited by examiner

*Primary Examiner* — Sumati Lefkowitz
*Assistant Examiner* — Ieesha Gillis
(74) *Attorney, Agent, or Firm* — Oliff & Berridge, PLC

(57) ABSTRACT

A liquid crystal device includes a plurality of pixels disposed in the shape of a matrix of n rows×m columns (where n and m are natural numbers equal to or larger than two), n scanning lines, 2m data lines including pairs of a first data line and a second data line for each column of the plurality of pixels, and a data line driving circuit that generates a first gray scale voltage corresponding to higher bits acquired by dividing gray scale data of plural bits into the higher bits and lower bits and generates a second gray scale voltage corresponding to the lower bits. Each one of the plurality of pixels includes a first switching element and a second switching element which are controlled to be turned on or off by the common scanning lines, a first pixel electrode to which the first or second gray scale voltage is supplied from the first data line through the first switching element, and a second pixel.

16 Claims, 17 Drawing Sheets

FIG. 12

LOOKUP TABLE

| INPUT | OUTPUT |
|---|---|
| 0 | 0 |
| 1 | 9 |
| 2 | 18 |
| 3 | 27 |
| 4 | 36 |
| 5 | 44 |
| 6 | 53 |
| 7 | 61 |
| 8 | 69 |
| 9 | 77 |
| 10 | 84 |
| ⋮ | ⋮ |
| 123 | 501 |
| 124 | 503 |
| 125 | 506 |
| 126 | 509 |
| 127 | 511 |
| 128 | 514 |
| 129 | 517 |
| 130 | 519 |
| 131 | 522 |
| 132 | 524 |
| 133 | 527 |
| ⋮ | ⋮ |
| 245 | 939 |
| 246 | 946 |
| 247 | 954 |
| 248 | 962 |
| 249 | 970 |
| 250 | 978 |
| 251 | 987 |
| 252 | 996 |
| 253 | 1005 |
| 254 | 1014 |
| 255 | 1023 |

LIQUID CRYSTAL DEVICE, DRIVING CIRCUIT FOR LIQUID CRYSTAL DEVICE, METHOD OF DRIVING LIQUID CRYSTAL DEVICE, AND ELECTRONIC APPARATUS

BACKGROUND

1. Technical Field

The present invention relates to a liquid crystal device, a driver circuit of a liquid crystal device, a method of driving a liquid crystal device, and an electronic device.

2. Related Art

As the number of display gray scale levels of a liquid crystal device increases, the configuration of a data line driving circuit that drives data lines becomes more complicated. For example, since the required gray scale voltage increases, the configuration of a gray scale voltage generating circuit becomes complicated. In addition, the number of switches for selecting one among a plurality of gray scale voltages increases as the number of the gray scale levels increases.

In addition, as the number of the display gray scale levels increases, a high-level source voltage is required for generating the gray scale voltages, and the size of transistors are required to be enlarged for acquiring a required withstand-voltage. In addition, as the level of the source voltage increases, power consumption of a gray scale voltage generating circuit increases.

As technology for implementing a data line driving circuit that can respond to an increase in the number of display gray scale levels, for example, there is technology disclosed in JP-A-H9-198012. In the technology disclosed in JP-A-H9-198012, multiple gray scale levels are implemented by generating an electric potential more delicate than an adjacent gray scale electric potential by using a CDAC (capacitive D/A converter) in a data line driving circuit.

In addition, in JP-A-2003-302942, technology relating to the present invention is disclosed. In JP-A-2003-302942, a liquid crystal device that is driven by a differential voltage of two data lines by using a pixel structure in which a pair of transfer switches connected to different data lines and a pair of liquid crystal electrodes are disposed for each pixel is disclosed.

By using the technology disclosed in JP-A-H9-198012, although the number of gray scale voltages can be decreased, however, the configuration of the CDAC (capacitive D/A converter) becomes complicated, and thus the whole circuit cannot be sufficiently simplified.

In addition, according to the technology disclosed in JP-A-2003-302942, the structure of the pixel is the same as that used in an embodiment of the present invention. However, in JP-A-2003-302942, one pair of "display data signals that have an almost same absolute differential value with respect to a virtual center electric potential and have different polarities", "a fixed electric potential and a display data signal", and "a common signal (com) having two values for positive and negative recording and a display data signal" is applied to the two data lines. In such a case, a desired display gray scale can be implemented. However, the technology does not directly contribute to simplification of the configuration of the data line driving circuit, a decrease in the withstand-voltage of transistors used in the data line driving circuit, or low power consumption of the data line driving circuit.

SUMMARY

An advantage of some aspects of the invention is that it provides a liquid crystal device for multiple gray scale level display which can markedly simplify the configuration of the data line driving circuit and implement a decrease in withstand-voltages of transistors used in the data line driving circuit and low power consumption of the data line driving circuit.

According to a first aspect of the present invention, there is provided a liquid crystal device including: a plurality of pixels disposed in the shape of a matrix of n rows×m columns (where n and m are natural numbers equal to or larger than two); n scanning lines; 2m data lines including pairs of a first data line and a second data line for each column of the plurality of pixels; and a data line driving circuit that generates a first gray scale voltage corresponding to higher bits acquired by dividing gray scale data of plural bits into the higher bits and lower bits and generates a second gray scale voltage corresponding to the lower bits. Each one of the plurality of pixels includes a first switching element and a second switching element which are controlled to be turned on or off by the common scanning lines, a first pixel electrode to which the first or second gray scale voltage is supplied from the first data line through the first switching element, and a second pixel electrode to which the second or first gray scale voltage is supplied from the second data line through the second switching element.

In the aspect above, the gray scale data of plural bits is divided into the higher bits and the lower bits, the first and second gray scale voltages corresponding to the higher bits and the lower bits are generated, and the first and second gray scale voltages are supplied to the pair of liquid crystal electrodes disposed for each pixel, and thereby multiple gray scale display is implemented. As the number of bits increases, the number of gray scale voltages (and the number of the switches for selecting the gray scales voltages) increases in the power of two. However, according to the configuration of the invention, the gray scale data is 2-divided into the higher bits and the lower bits, and accordingly, the number of bits decreases by half. Thus, the number of required gray scale voltages (and the number of the switches for selecting the gray scale voltages) markedly decreases. Accordingly, the configuration of the data line driving circuit can be simplified. In addition, since a variable range (dynamic range) of the gray scale voltages on the lower bit side is small, low withstand-voltage elements can be used in a circuit relating to generation of the gray scale voltages on the lower bit side, and the circuit can be operated at a low source voltage level. Therefore, miniaturization, low power consumption, and low cost of the data line driving circuit (and the liquid crystal device) can be achieved.

In a liquid crystal device according to a second aspect of the invention, the data line driving circuit is configured to generate the first gray scale voltage corresponding to k higher bits acquired by dividing the gray scale data of 2k (where k is a natural number equal to or larger than one) bits into the k higher bits and k lower bits and generate the second gray scale voltage corresponding to the k lower bits.

There are various methods of dividing higher bits and lower bits, and the method is not limited to a specific method. However, it is the most efficient to equally divide the higher bits and the lower bits into k bits each for 2k bit (k is a natural number equal to or larger than 1) gray scale data. In such a case, the number of gray scale voltage levels determined by the higher bits is equal to that determined by the lower bits, and thereby it becomes easy to implement a symmetrical circuit. In addition, since the numbers of higher-bit switches and lower-bit switches which are used for selecting one from among the plurality of gray scale voltage levels become the same, the configuration of the circuit becomes symmetrical, and thereby it becomes easy to implement the most compact layout of the circuit.

In a liquid crystal device according to a third aspect, data line driving circuit is configured to generate the first gray scale voltage corresponding to k higher bits acquired by dividing the gray scale data of 2k−1 (where k is a natural number equal to or larger than two) bits into the k higher bits and k−1 lower bits and generate the second gray scale voltage corresponding to the k−1 lower bits.

In the aspect above, an example of a method of dividing the gray scale data into the higher bits and the lower bits is clearly specified in a case where the total number of bits of the gray scale data is odd (that is, 2k−1 bits) In other words, in this aspect, the gray scale data is divided into higher k bits and lower (k−1) bits. By dividing the gray scale data such that the number of the higher bits is close to the number of the lower bits, the numbers of selection switches for the higher bits and the lower bits can be minimized. In addition, since a difference between the numbers of switches is also minimized, it becomes easy to dispose the switches with high density, and therefore there is an advantage for layout.

In a liquid crystal device according to a fourth aspect, the data line driving circuit generates the first gray scale voltage corresponding to k−1 higher bits acquired by dividing the gray scale data of 2k−1 (where k is a natural number equal to or larger than two) bits into the k−1 higher bits and k lower bits and generates the second gray scale voltage corresponding to the k lower bits.

In the aspect above, another example of a method of dividing the gray scale data into the higher bits and the lower bits is clearly specified in a case where the total number of bits of the gray scale data is odd (that is, 2k−1 bits). In other words, in this aspect, the gray scale data is divided into higher (k−1) bits and lower k bits. By dividing the gray scale data such that the number of the higher bits is close to the number of the lower bits, the numbers of selection switches for the higher bits and the lower bits can be minimized. In addition, since a difference between the numbers of switches is also minimized, it becomes easy to dispose the switches with high density, and therefore there is an advantage for layout.

In a liquid crystal device according to a fifth aspect, the data line driving circuit generates $2^k$ gray scale voltages, which have equal voltage differences therebetween, corresponding to $2^k$ higher bits by performing a "$2^k-1$" dividing operation for a voltage corresponding to a gray scale range determined by the k higher bits and generates $2^k$ gray scale voltages corresponding to the lower bits which have equal voltage differences therebetween and satisfy voltage relationship of "$VL_s-VL_{s-1}=(VH_p-VH_{p-1})/2^k$" where the gray scale voltages corresponding to the higher bits are represented as $VH_p$ (where p is an integer in the range of 1 to $2^k-1$) and the gray scale voltages corresponding to the lower bits are represented as $VL_s$ (where s is an integer in the range of 1 to $2^k-1$), and the data line driving circuit supplies a selected gray scale voltage corresponding to the higher bits to the first data line or the second data line by selectively turning on one of $2^k$ switches disposed in correspondence with the gray scale voltages corresponding to the higher bits, and supplies a selected gray scale voltage corresponding to the lower bits to the second data line or the first data line by selectively turning on one of $2^k$ switches disposed in correspondence with the gray scale voltages corresponding to the lower bits.

In the aspect above, a method of generating the higher and lower gray scale voltages in the liquid crystal device (the liquid crystal device that has an even total number of bits of the gray scale data and divides the gray scale data into the higher and lower bits having equal numbers of bits) according to the second aspect is clearly specified, and selection one from the generated higher and lower gray scale data by using a switch is clearly specified. The generation of the gray scale voltages can be performed by drawing out a plurality divided voltages, for example, from ladder resistors in parallel. In such a case, simplification of the configuration of the circuit and effective generation of a plurality of gray scale voltage levels in a speedy manner can be made. When, for example, an analog switch or the like is used as a switch for selecting one from among the plurality of gray scale voltages, a required gray scale voltage level can be precisely selected in a speedy manner.

In a liquid crystal device according to a sixth aspect of the invention, the data line driving circuit generates $2^k$ gray scale voltages, which have equal voltage differences therebetween, corresponding to $2^k$ higher bits by performing a "$2^k-1$" dividing operation for a voltage corresponding to a gray scale range determined by the k higher bits and generates $2^{(k-1)}$ gray scale voltages corresponding to the lower bits which have equal voltage differences therebetween and satisfy voltage relationship of "$VL_s-VL_{s-1}=(VHp-VH_{p-1})/2^{(k-1)}$" where the gray scale voltages corresponding to the higher bits are represented as VHp (where p is an integer in the range of 1 to $2^k-1$) and the gray scale voltages corresponding to the lower bits are represented as $VL_s$ (where s is an integer in the range of 1 to $2^k-1$), and the data line driving circuit supplies a selected gray scale voltage corresponding to the higher bits to the first data line or the second data line by selectively turning on one of $2^{(k-1)}$ switches disposed in correspondence with the gray scale voltages corresponding to the higher bits, and supplies a selected gray scale voltage corresponding to the lower bits to the second data line or the first data line by selectively turning on one of $2^{(k-1)}$ switches disposed in correspondence with the gray scale voltages corresponding to the lower bits.

In the aspect above, a method of generating the higher and lower gray scale voltages in the liquid crystal device (the liquid crystal device that has an odd total number of bits of the gray scale data and divides the gray scale data into the higher k bits and the lower (k−1) bits) according to the third aspect is clearly specified, and selection one from the generated higher and lower gray scale data by using a switch is clearly specified.

In a liquid crystal device according to a seventh aspect of the invention, the data line driving circuit generates $2^{(k-1)}-1$ gray scale voltages, which have equal voltage differences therebetween, corresponding to k−1 higher bits by performing a "$2^{(k-1)}-1$" dividing operation for a voltage corresponding to a gray scale range determined by the k higher bits and generates $2^k$ gray scale voltages corresponding to the lower bits which have equal voltage differences therebetween and satisfy voltage relationship of "$VL_s-VL_{s-1}=(VH_p-VH_{p-1})/2^k$" where the gray scale voltages corresponding to the higher bits are represented as $VH_p$ (where p is an integer in the range of 1 to $(2^{(k-1)}-1)$) and the gray scale voltages corresponding to the lower bits are represented as VLs (where s is an integer in the range of 1 to $2^k-1$), and the data line driving circuit supplies a selected gray scale voltage corresponding to the higher bits to the first data line or the second data line by selectively turning on one of $2^{(k-1)}$ switches disposed in correspondence with the gray scale voltages corresponding to the higher bits, and supplies a selected gray scale voltage corresponding to the lower bits to the second data line or the first data line by selectively turning on one of $2^k$ switches disposed in correspondence with the gray scale voltages corresponding to the lower bits.

In the aspect above, a method of generating the higher and lower gray scale voltages in the liquid crystal device (the liquid crystal device that has an odd total number of bits of the gray scale data and divides the gray scale data into the higher (k−1) bits and the lower k bits) according to the fourth aspect is clearly specified, and selection one from the generated higher and lower gray scale data by using a switch is clearly specified.

In a liquid crystal device according an eighth aspect of the invention, the data line driving circuit includes a first gray scale voltage generating circuit that generates the first gray scale voltage and a second gray scale voltage generating circuit that generates the second gray scale voltage.

In the aspect above, the gray scale voltage generating circuits (the first and second gray scale voltage generating circuits) are separately disposed in correspondence with the first and second gray scale voltages. By disposing separate gray scale voltage generating circuits, an optimized circuit configuration according to the numbers of the higher and lower bits or the like can be implemented.

In a liquid crystal device according to a ninth aspect of the invention, the data line driving circuit alternately supplies the first gray scale voltage and the second gray scale voltage to the first data line and the second data line periodically.

In the aspect above, by alternately applying the first and second gray scale voltages to one pair of the liquid crystal electrodes of one pixel, burn-in of the liquid crystal can be prevented. In addition, an advantage that deterioration of the display quality is suppressed by offsetting a voltage variance applied to the liquid crystal due to feed-through can be acquired.

In a liquid crystal device according to a tenth aspect of the invention, the data line driving circuit alternately supplies the first gray scale voltage and the second gray scale voltage to the first data line and the second data line for each frame period.

In the aspect above, it is clearly specified that the liquid crystal electrodes are driven alternately for each frame. Since a high speed circuit operation is not needed for alternating the driving operation for each screen, the alternation for each screen can be implemented in an easy manner.

In a liquid crystal device according to an eleventh aspect of the invention, the data line driving circuit supplies the second gray scale voltages to the first and second data lines of pixels disposed in a (Q+1)-th (where Q is an arbitrary integer in the range of one to m−1) column in a case where the data line driving circuit supplies the first gray scale voltages to the first and second data lines of the pixels disposed in a Q-th column.

In the aspect above, by shifting the types of the gray scale voltages applied to the first and second liquid crystal electrodes of pixels adjacent in the scanning line direction, flicker can be reduced.

In a liquid crystal device according to a twelfth aspect of the invention, a withstand-voltage of a transistor relating to generation or path selection of the second gray scale voltage is set to be lower than that of a transistor relating to generation or path selection of the first gray scale voltage in the data line driving circuit.

Since a variable range (dynamic range) of the gray scale voltages on the lower bit side is small, low withstand-voltage elements can be used in a circuit relating to generation of the gray scale voltages on the lower bit side. Accordingly, it is possible to effectively suppress an increase in the area of the circuit.

In a liquid crystal device according to a thirteenth aspect of the invention, a high level source voltage of a circuit generating the second gray scale voltage is set to be lower than that of a circuit generating the first gray scale voltage in the data line driving circuit.

In the aspect above, since a variable range (dynamic range) of the gray scale voltages on the lower bit side is small, low withstand-voltage elements can be used in a circuit relating to generation of the gray scale voltages on the lower bit side, compared to the circuit for generating the gray scale voltages corresponding to the higher bits. Therefore, low power consumption and low cost of the data line driving circuit (and the liquid crystal device) can be achieved.

According to a fourteenth aspect of the invention, there is provided an electronic apparatus including the liquid crystal device according to an aspect of the invention.

In the aspect above, the liquid crystal device is appropriate for miniaturization, low power consumption, and low cost, the miniaturization, and consequently, miniaturization, low power consumption, and low cost of the electronic apparatus can be achieved.

According to a fifteenth aspect of the invention, there is provided a data line driving circuit including; a first gray scale voltage generating circuit that generates a plurality of first gray scale voltages corresponding to higher bits based on the higher bits acquired by dividing gray scale data of plural bits into the higher bits and lower bits; a second gray scale voltage generating circuit that generates a plurality of second gray scale voltages corresponding to the lower bits based on the lower bits; and an output circuit including a switching circuit for selecting one from among the plurality of the first gray scale voltages and a switching circuit for selecting one from among the plurality of the second gray scale voltages.

In the aspect above, miniaturization, low power consumption, and low cost of the data line driving circuit can be acquired.

In a data line driving circuit according to a sixteenth aspect of the invention, a conversion circuit that converts the number of gray scale data is further included.

In the aspect above, it is possible to appropriately perform a flexible γ correction operation, for example, in accordance with the electro-optical characteristic of the liquid crystal.

According to a seventeenth aspect of the invention, there is provided a method of driving a liquid crystal device having a plurality of pixels disposed in the shape of a matrix. The method includes: generating a first gray scale voltage on the basis of higher bits acquired by dividing gray scale data of plural bits into the higher bits and lower bits; generating a second gray scale voltage on the basis of the lower bits; supplying a first gray scale voltage and a second gray scale voltage having a polarity opposite to that of the first gray scale voltage to a first liquid crystal electrode and a second liquid crystal electrode which are disposed in one pixel; and alternately supplying the first gray scale voltage and the second gray scale voltage to the first liquid crystal electrode and the second liquid crystal electrode periodically.

In this aspect, a new method of applying the gray scale voltages to one pair of liquid crystal electrodes is implemented. In addition, by alternating the types of the gray scale voltages to one pair of the liquid crystal electrodes periodically, alternation of voltages can be implemented. In the voltage alternation process, an application for reducing the flicker by setting the types of the gray scale voltages applied to one pair of the liquid crystal electrodes of adjacent pixels in the scanning line direction to be opposite to each other may be made.

According to an embodiment of the invention, in a liquid crystal device that performs multiple gray scale level display with high precision, the configuration of the data line driving circuit can be markedly simplified and a decrease in withstand-voltages of transistors used in the data line driving circuit and low power consumption of the data line driving circuit can be implemented.

BRIEF DESCRIPTION OF THE DRAWINGS

The invention will be described with reference to the accompanying drawings, wherein like numbers reference like elements.

FIG. 12 is a diagram showing an example of the contents of a lookup table for γ correction according to an embodiment of the invention.

DESCRIPTION OF EXEMPLARY EMBODIMENTS

Figure 1:
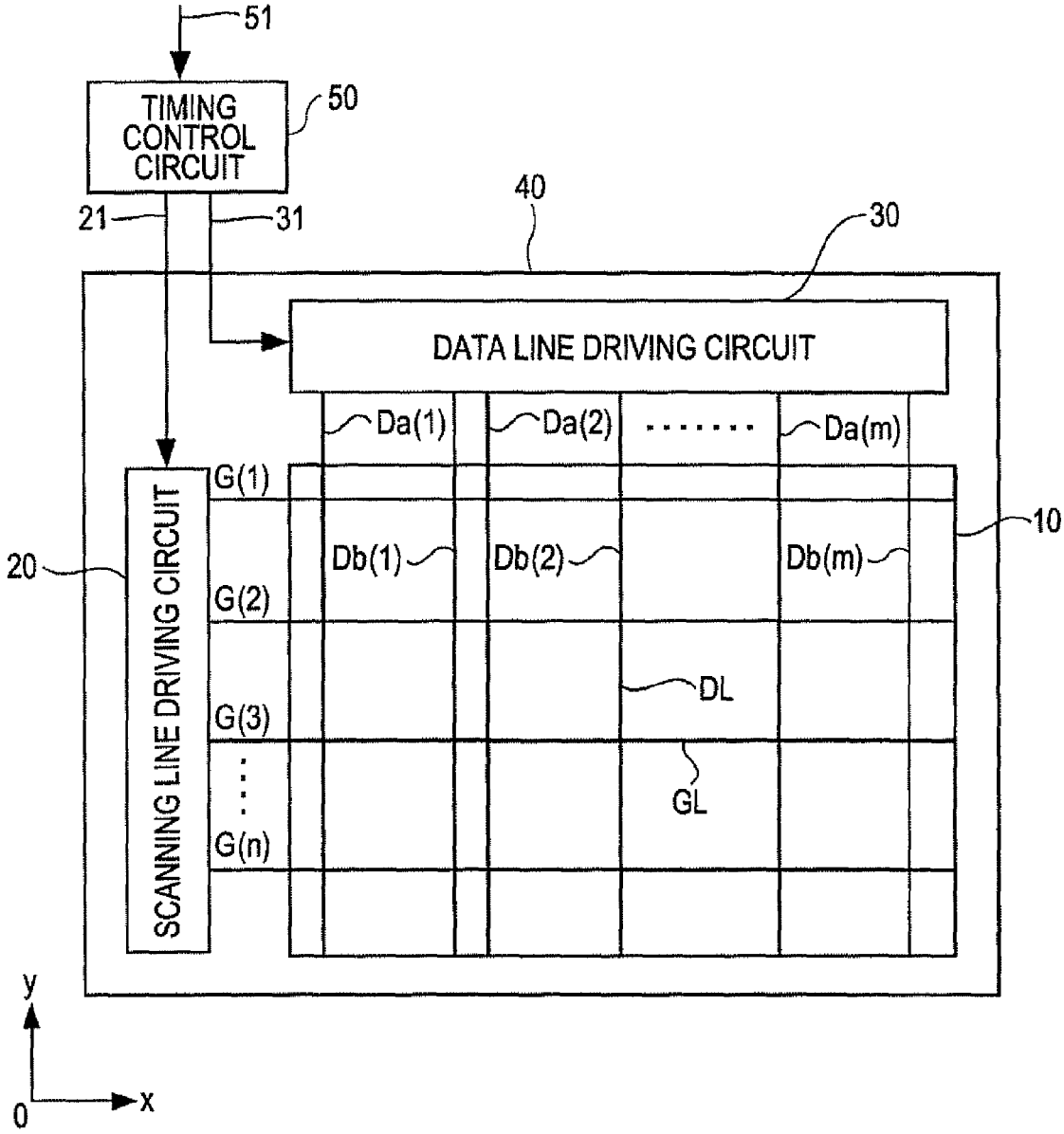
FIG. 1 is a diagram showing the whole configuration of an example of an active matrix-type liquid crystal device according to an embodiment of the present invention.

Next, embodiments of the present invention will be described with reference to the accompanying drawings. The embodiments described below are not for the purpose of unreasonably limiting the scope of the invention defined by claims. Furthermore, it cannot be determined that all the constituent members described in the embodiments are essential as solving means of the invention.

First Embodiment

Whole Configuration of Liquid Crystal Device

A liquid crystal device has a pair of substrates disposed to face each other with a liquid crystal interposed therebetween. On a liquid crystal side of one substrate of the liquid crystal, scanning lines GL that extend in direction x and are disposed in direction y in parallel, and data line DL that extend in direction y and disposed in direction x in parallel are formed.

Each scanning line GL is connected to a scanning line driving circuit 20 at least on its one end, and scanning line driving signals G(1), G(2), . . . , G(n) are configured to be sequentially supplied by the scanning line driving circuit 20.

Each data line DL is connected to a data line driving circuit 30 at least on its one end, and, for example image signals Da(1), Db(2), Da(2), Db(2), . . . , Da(m), Db(m), which are sequentially represented from the left side in the figure, are configured to be supplied in accordance with timings of supply of the scanning line driving signals G by the data line driving circuit 30.

A pixel is configured to be an area surrounded by a pair of adjacent scanning lines GL and a pair of adjacent data lines DL to which the image signals Da and Db are supplied, and aggregation of pixels is configured as a pixel unit 10.

Thus, the liquid crystal device has a configuration in which n scanning lines GL and 2m data lines DL are included for pixels in the shape of a matrix of n rows×m columns.

The scanning line driving circuit 20 and the data line driving circuit 30 are configured to receive a scanning line driving control signal 21 and a data line driving control signal 31 from a timing control circuit 50 and output the scanning line driving signals G and the image signals Da and Db. A reference numeral 51 denotes an external input signal such as a power source or display data.

Configuration of Pixel

Figure 2:
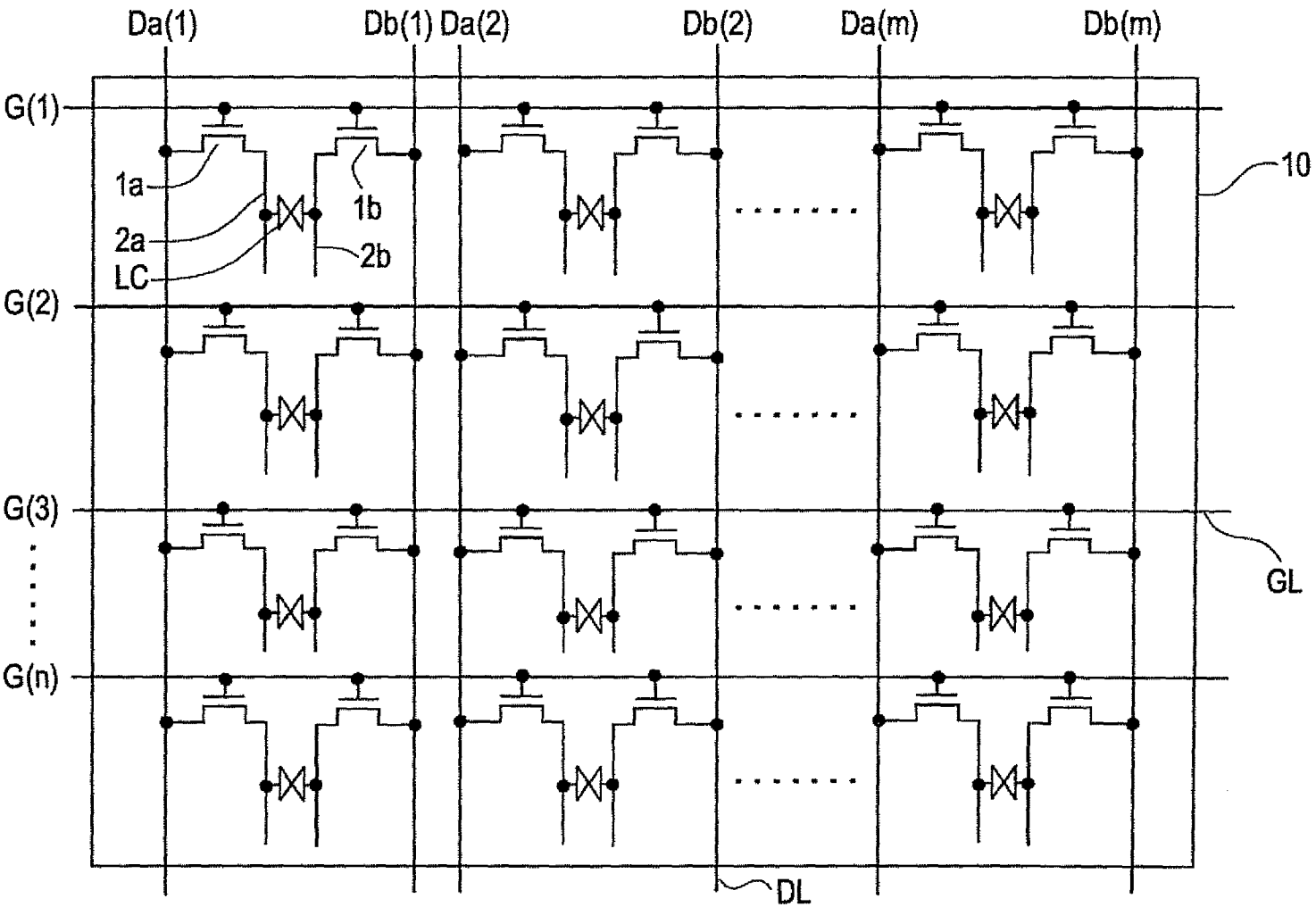
FIG. 2 is a diagram showing an example of the configuration of pixels of a pixel unit of the liquid crystal device shown in FIG. 1.

FIG. 2 is a diagram showing an example of the configuration of pixels of the pixel unit of the liquid crystal device shown in FIG. 1. In each pixel, first, a pair of thin film transistors (TFT: NMOS transistors as transfer switches) 1*a* and 1*b* that are controlled to be turned on or off in accordance with a scanning line driving signal G(i) (i=1, 2, . . . ) transmitted from a corresponding scan line GL is disposed. These thin film transistors 1*a* and 1*b* are implemented by MIS (metal insulator semiconductor) type transistors, and gate electrodes of the thin film transistors are connected to the scanning line GL.

In addition, one electrode (may be referred to as a drain electrode for the convenience of description) of electrodes other than the gate electrode of the thin film transistor 1*a* is connected to a corresponding data line DL to which the image signal Da is supplied, and one electrode (may be referred to as a drain electrode for the convenience of description) of electrodes other than the gate electrode of the thin film transistor 1*b* is connected to a corresponding data line DL to which the image signal Db is supplied.

In other words, in one pixel, the TFTs 1*a* and 1*b* serving as a pair of transfer switches are included. The gates of the pair of TFTs 1*a* and 1*b* are connected to a common scanning line GL. In addition, one ends of the TFTs are connected to the data lines Da(1) and Db(1), and the other ends of the TFTs are connected to the pixel electrodes 2*a* and 2*b* of a liquid crystal LC.

Between the pixel electrodes 2*a* and 2*b*, the liquid crystal LC is disposed. The alignment of molecules of the liquid crystal LC changes depending on an electric field generated due to a voltage difference between the pixel electrodes 2*a* and 2*b*, and thereby the light transmittance thereof changes.

For example, an image voltage corresponding to higher-bit image data of gray scale image data is applied to the pixel electrode 2*a*, and an image voltage corresponding to lower-bit image data of the gray scale image data is applied to the pixel electrode 2*b* (this aspect will be described later).

The pixel electrodes 2*a* and 2*b* forming one pair are driven by two independent data lines (one pair of data lines), and the polarity of the gray scale voltage applied to each electrode is required to be inverted periodically. The structure of a pixel for inverting the polarity of the one pair of the liquid crystal electrodes 2*a* and 2*b* alternately can be easily implemented by using so-called a traversal field-type liquid crystal in which two electrodes 2*a* and 2*b* are disposed together on one substrate side (however, the present invention is not limited thereto).

The traversal field-type liquid crystal includes an IPS (in-plane switching) liquid crystal. While an FFS (fringe field switching) liquid crystal is referred to as a fringing field switching liquid crystal or an oblique field liquid crystal, the FFS liquid crystal controls the alignment of liquid crystal molecules by using a traversal electric field, which is the same as the IPS liquid crystal. Thus, in descriptions here, the traversal electric field-type liquid crystal includes the FFS liquid crystal.

Operation for Driving Pixel

Figure 3:
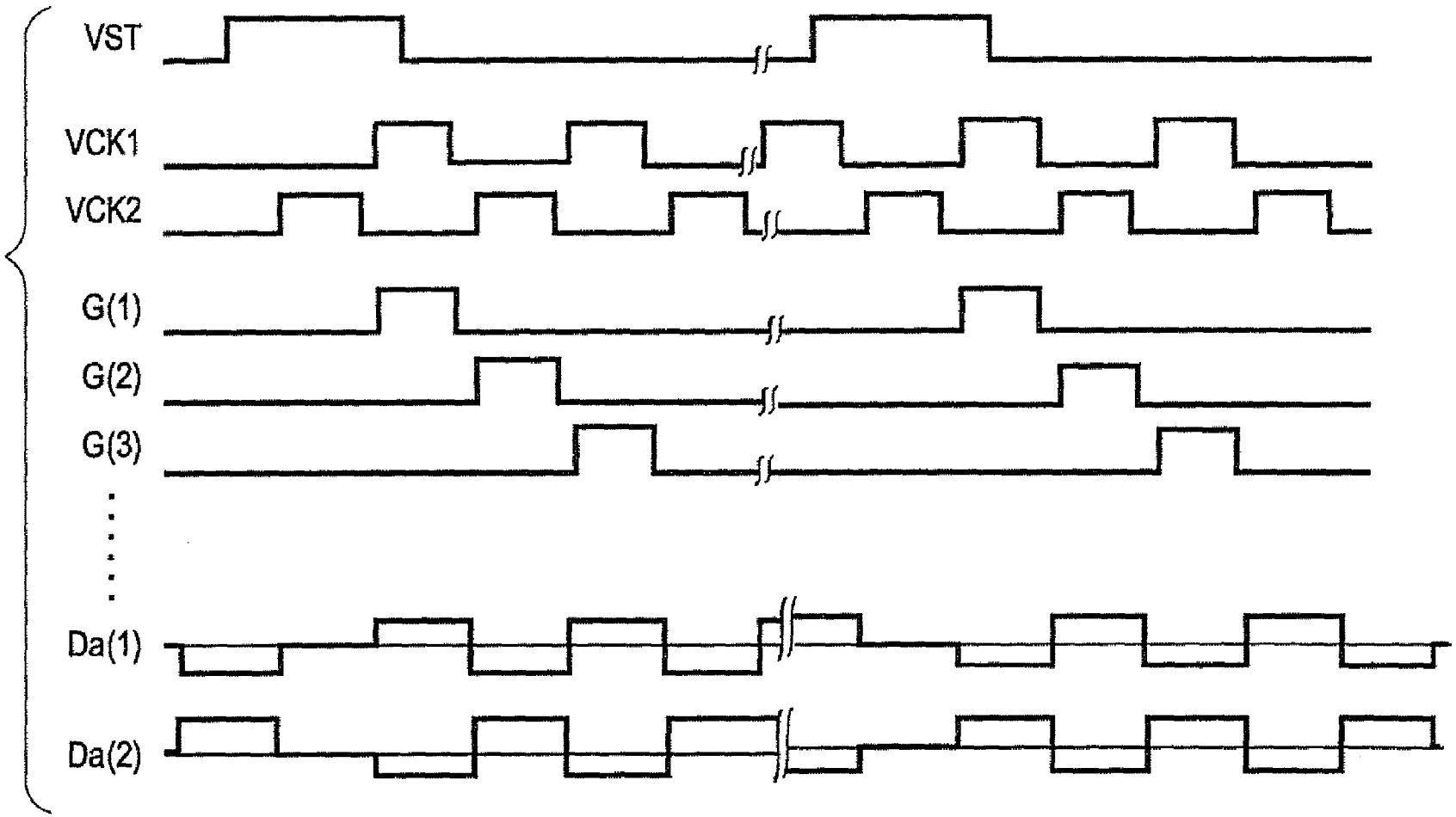
FIG. 3 is a timing chart showing drive timings of a pixel according to an embodiment of the invention.

FIG. 3 is a timing chart showing drive timings of a pixel. In FIG. 3, VST represents a start signal. In addition, VCK1 and VCK2 represent clock signals. These signals are included in a scanning line driving control signal 21.

The phases of scanning line driving signals G(1), G(2), G(3), etc. are sequentially changed in synchronization with the clock signals VCK1 and VCK2. In addition, the polarities thereof are shifted for each period of the start signal VST, and the signals are formed to be so-called "alternated".

Accordingly, for example, when image signals (gray scale voltages) Da and Db (that is, an image signal of the higher bits and an image signal of the lower bits) are supplied to the electrodes 2*a* and 2*b* of one pixel driven in accordance with the scanning line driving signal G(1) of the first row in a frame, in the next frame, the electrodes to which the image signals Da and Db are supplied are shifted. Accordingly, an advantage that burn-in is prevented can be acquired. In addition, there is an advantage that the effect of variances of the voltage level applied to the liquid crystal due to feed-through is reduced can be acquired (this aspect will be described later with reference to FIG. 14).

In addition, for example, when the image signals Da and Db (that is, the image signal of the higher bits and the image signal of the lower bits) are supplied to the electrodes 2*a* and 2*b* of the m-th row and n-th column pixel, it is preferable that the image signals Da and Db are supplied to the electrodes 2*b* and 2*a* of a pixel of the (m+1)-th row and the n-th column pixel that is located next thereto. In other words, flicker can be reduced by inverting polarity for each adjacent pixel (dot).

In addition, likewise, it is preferable that the pixel electrodes to which image signals Da(i) and Db(i) are supplied are shifted (that is, the polarities of the liquid crystals are shifted) for each horizontal period 1H (that is, for each scanning line). In such a case, flicker can be reduced.

Detailed Example of Driving Pixel

Figure 4A:
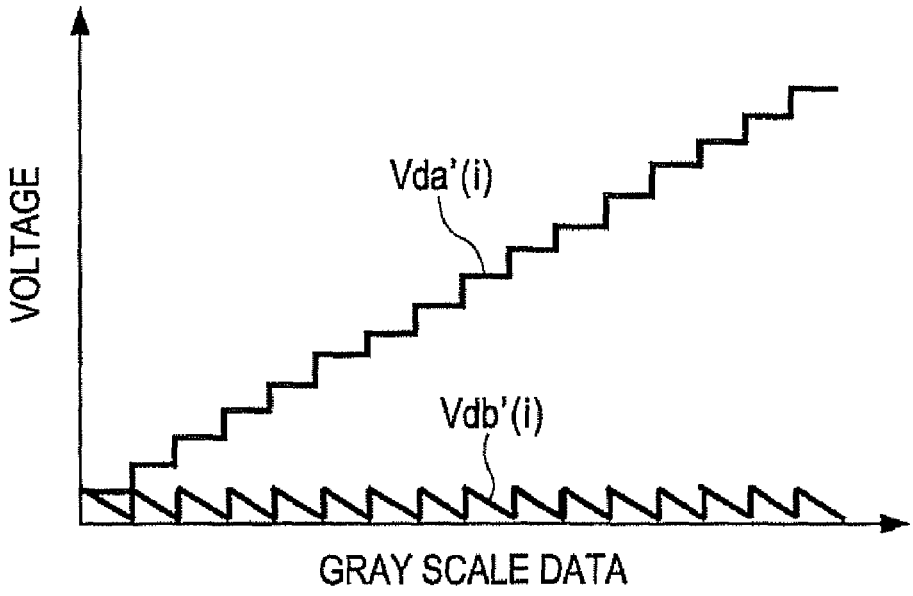
FIGS. 4A and 4B are diagrams showing input-output characteristics (gray scale voltage levels with respect to input gray scale levels) of gray scale voltages which are supplied to one pair of pixel electrodes.
Figure 4B:
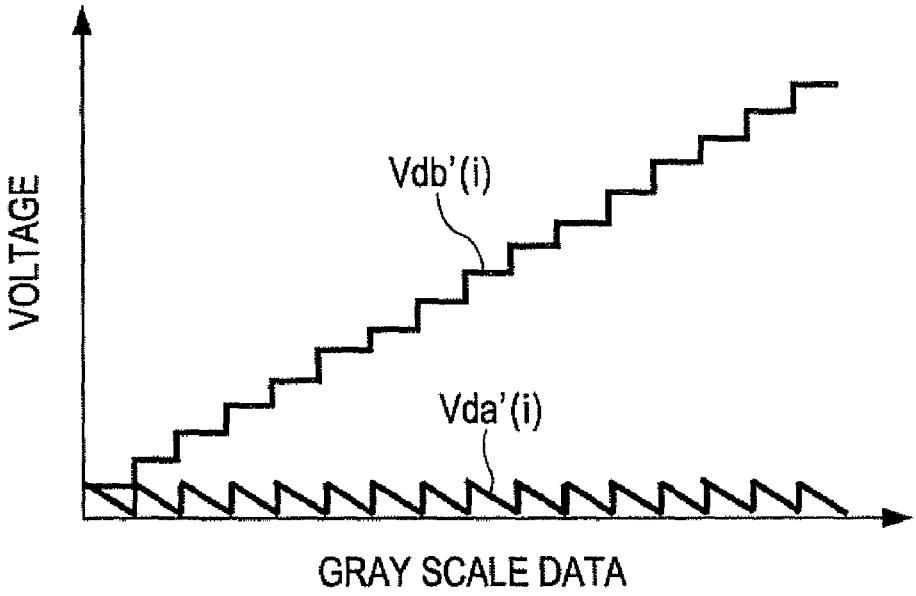

FIGS. 4A and 4B are diagrams showing input-output characteristics (gray scale voltage levels with respect to input gray scale levels) of gray scale voltages Vda'(i) and Vdb'(i) corresponding to the higher bits and lower bits which are supplied to one pair of pixel electrodes.

In descriptions below, the gray scale voltages Vda'(i) and Vdb'(i) which are supplied to one pair of pixel electrodes may be referred to as one pair of recording voltages.

FIG. 4A shows an input-output characteristic for positive polarity recording, and FIG. 4B shows an input-output output characteristic for negative polarity recording. A difference between gray scale voltages Vda'(i) and Vdb'(i) corresponding to the higher bits and the lower bits is a voltage level VLC applied to a liquid crystal (LC) of each pixel. As described above, for example, by shifting (shifting electrodes to which the voltages are applied) the gray scale voltages Vda'(i) and Vdb'(i) for each frame, the voltages can be alternated. This alternation has an advantage of reducing the effect of feed-through along with an advantage of burn-in prevention.

Figure 14:
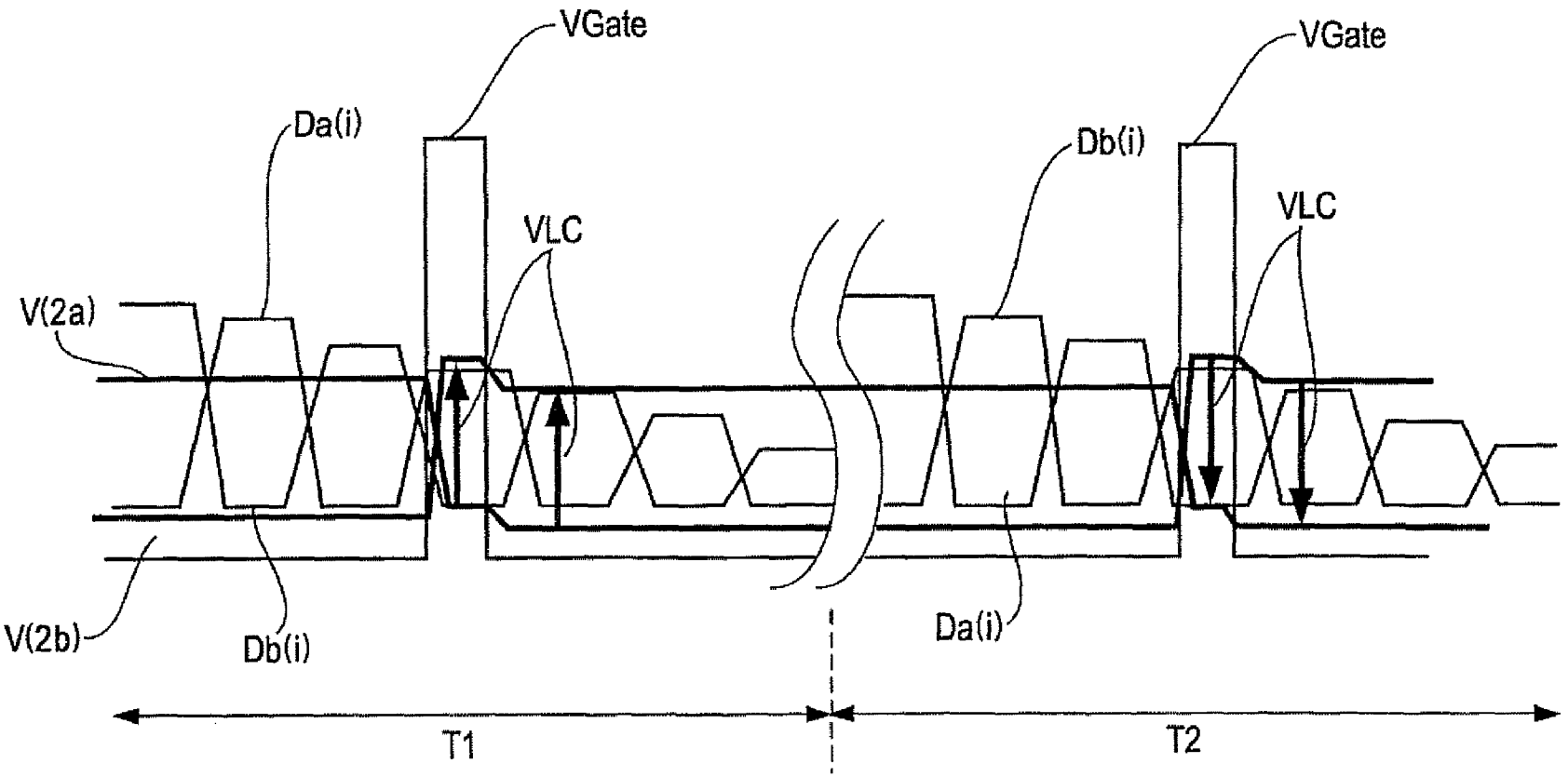
FIG. 14 is a diagram for showing cancel of feed-through by alternation in a method of driving a liquid crystal according to an embodiment of the invention.

FIG. 14 is a diagram for showing the advantage (an advantage acquired from reducing the effect of feed-through) acquired from alternating one pair of recording voltages Vda'(i) and Vdb'(i). The feed-through is a phenomenon that the voltage level applied to a liquid crystal (LC) varies as a variable voltage component is transmitted to the liquid crystal (LC) side through a parasitic capacitance by turning on/off the gate of a MOS transistor serving as a transfer switch.

In FIG. 14, voltage waveforms of image signals Da(i) and Db(i) applied to the pixel electrodes 2*a* and 2*b* in an actual driving state, a voltage waveform of a gate voltage (VGate) of a transfer switch (NMOS transistor), and voltage waveforms V(2*a*) and V(2*b*) representing temporal changes in substantial voltage levels applied to the pixel electrodes 2*a* and 2*b* are shown. V(2*a*) and V(2*b*) are represented by thick lines in the figure.

In FIG. 14, VLC represented by a thick arrow is a voltage level VLC (a driving voltage level of the liquid crystal) applied between both ends of the liquid crystal. Here, it should be noted that the directions of arrows of VLCs in the period T1 (positive polarity recording period) are opposite to those in the period T2 (negative polarity recording period).

As shown in the figure, although substantial voltage levels V(2*a*) and V(2*b*) applied to the pixel electrodes 2*a* and 2*b* momentarily change at timings when the gates of the transfer switches (NMOS transistors 1*a* and 1*b*) change from level ON to level OFF, almost the same amounts of variances are generated in the positive polarity recording period T1 and the negative polarity recording period T2, and accordingly, the effects of the feed-through are offset in the time axis. As described above, deterioration of display can be prevented more effectively by shifting (inverting the polarities of) the image signals Da(i) and Db(i) supplied to one pair of pixel electrodes 2*a* and 2*b*, for example, for each frame.

Example of Internal Configuration of Data line Driving Circuit (in a Case where 64 Gray Scale Levels are Implemented)

Figure 5:
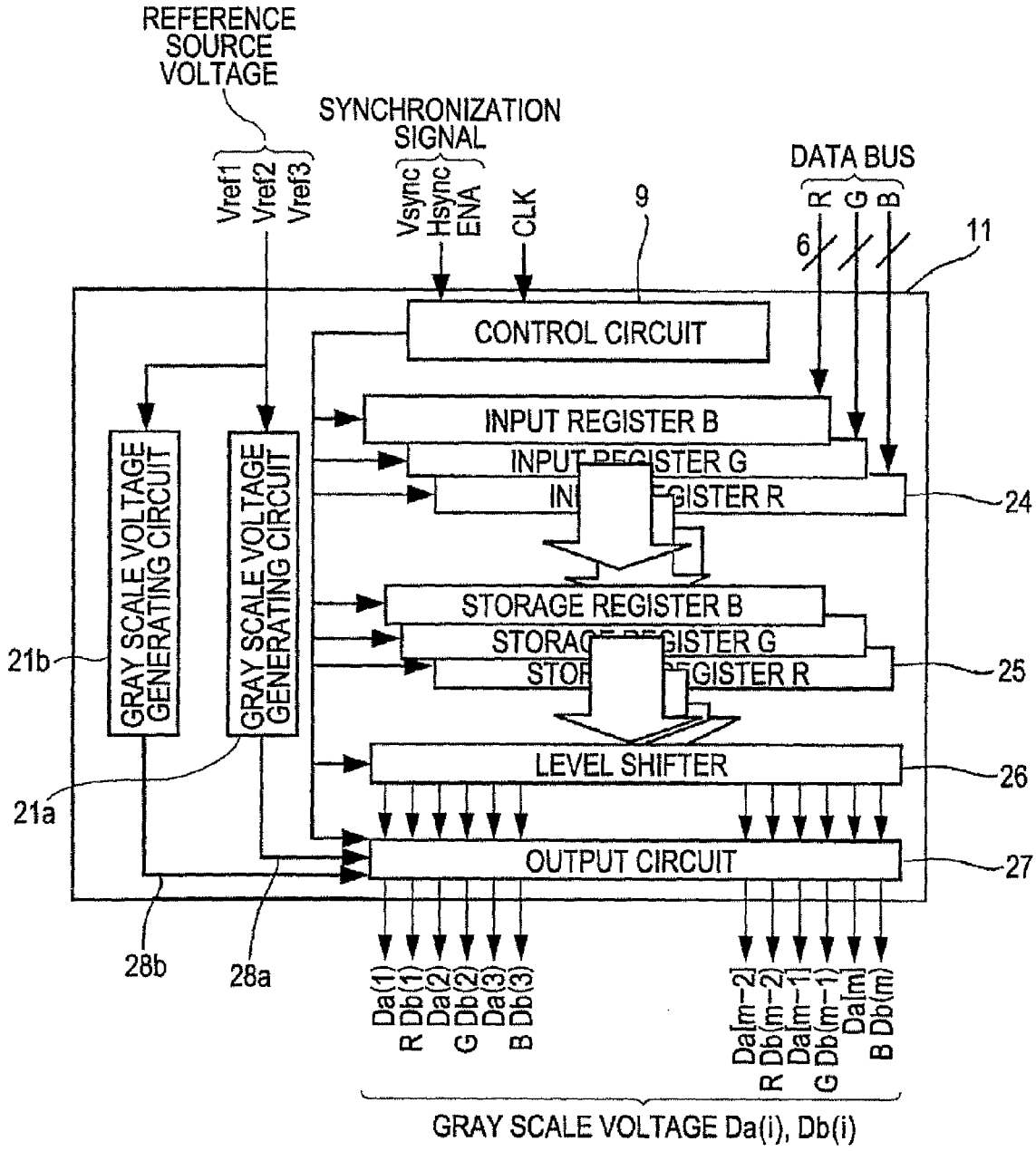
FIG. 5 is a block diagram showing the configuration of a data line driving circuit (data line driving IC) according to a first embodiment of the invention.

Next, the internal configuration of the data line driving circuit 30 will be described. FIG. 5 is a block diagram showing the configuration of the data line driving circuit (data line driving IC).

As shown in the figure, the data line driving circuit (data line driving IC) 30 has a control circuit 9, two gray scale voltage generating circuits 21*a* and 21*b*, an input register 24 that latches image data of each color (RGB) transmitted from a data bus, a storage register 25 that temporarily stores image data of each color, a level shifter 26, and an output circuit 27.

The control circuit 9 generates control signals based on input synchronization signals (a Vsync signal, an Hsync signal, and an enable signal ENA) and an operation clock CLK and controls other units by using the control signals.

The input register 24 inserts 6-bit image data of each color corresponding to the number of outputs in synchronization with the operation clock CLK.

The storage register 25 latches the image data, which has been transmitted from the input register 24, in a parallel mode in synchronization with the operation clock CLK, similarly.

The level of the image data latched by the storage register 25 is shifted by the level shifter 26, and the image data is supplied to the output circuit 27.

The gray scale voltage generating circuits 21*a* and 21*b* respectively generate gray scale voltages corresponding to 64 gray scale levels based on three values of reference source voltages Vref1, Vref2, and Vref3. The gray scale voltage generating circuit 21*a* generates gray scale voltage levels corresponding to the higher bits of the image data. The gray scale voltage generating circuit 21*b* generates gray scale voltage levels corresponding to the lower bits of the image data. In descriptions below, the gray scale voltage level may be referred to as a gradation voltage level.

The gray scale voltage levels, which have been generated by the gray scale voltage generating circuits 21*a* and 21*b*, corresponding to the higher bits and the lower bits are supplied to the output circuit 27 through voltage buses 28*a* and 28*b*.

The output circuit 27 generates one pair of image signals Da(i) and Db(i) (that is, Da(1) to Da(m) and Db(1) to Db(m)) for each color (RGB) and outputs the image signals to the data lines DL.

In the data line driving circuit 30 shown in FIG. 5, the image signals (gray scale voltage) output to the data lines DL are configured to have two series of Da(i) and Db(i) corresponding to one pair of data lines, and two gray scale voltage generating circuits 21*a* and 21*b* are disposed in correspondence with the two series of the image signals.

Figure 6:
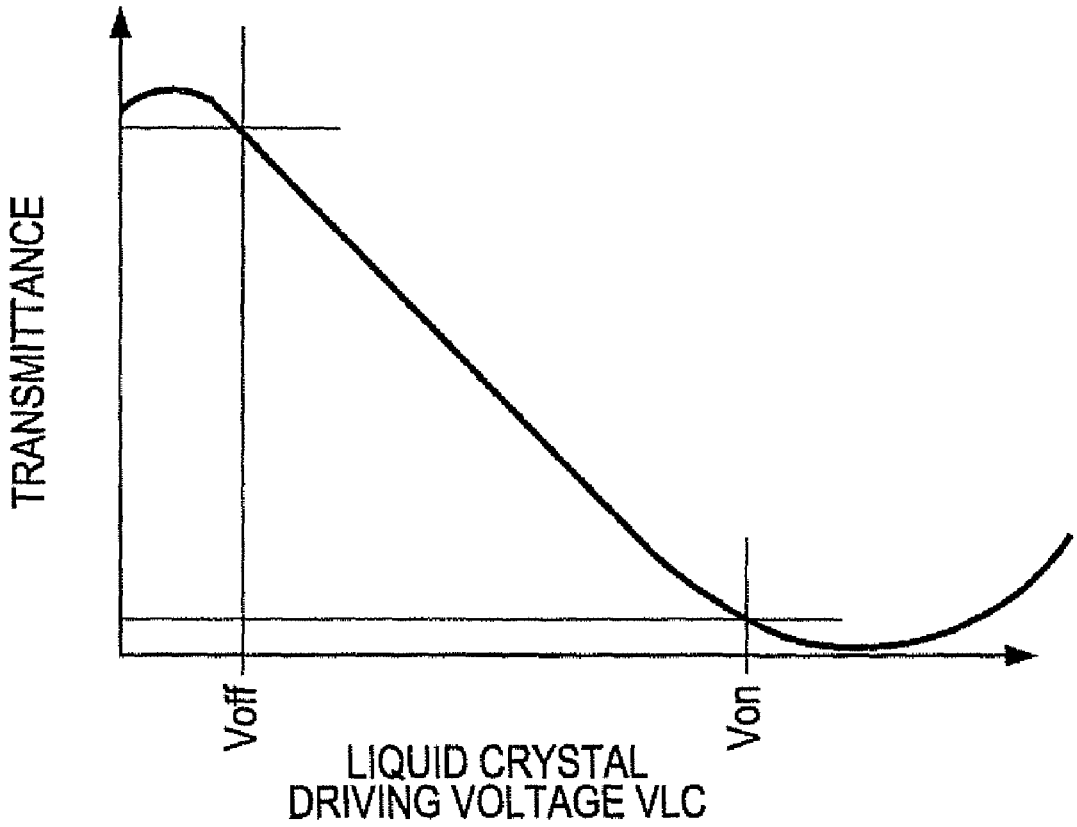
FIG. 6 is a diagram showing an example of an electro-optical characteristic of a liquid crystal.

FIG. 6 is a diagram showing an example of an electron optical characteristic of a liquid crystal. A data line driver 9 shown in FIG. 5 implements 64 gray scale levels by using a liquid crystal having the electro-optical characteristic shown in FIG. 6.

As shown in the figure, the liquid crystal shown in FIG. 6 has a region (a region corresponding to the liquid crystal driving voltage levels Voff to Von) in which light transmittance changes in a linear manner (in an ideally linear form) with respect to the driving voltage level VLC. Although a liquid crystal practically in use does not have such an ideally linear electro-optical characteristic, for the convenience of description of the principle operation of the liquid crystal according to an embodiment of the present invention, the liquid crystal having the electro-optical characteristic shown in FIG. 6 is considered.

The data line driver 30 shown in FIG. 5 is configured to represent 64 gray scale levels by using the linear region (the region corresponding to the liquid crystal driving voltage levels Voff to Von) of the liquid crystal shown in FIG. 6.

Principle of Bit-Divided Liquid Crystal Driving Method

In order to implement 64 gray scale levels, although 64 gray scale voltage levels are simply thought to be needed, however, according to an embodiment of the present invention, the liquid crystal LC is driven by simultaneously applying a gray scale image signal corresponding to the higher bits and a gray scale image signal corresponding to the lower bits to both electrodes of the liquid crystal LC and using a difference between the voltage levels applied to the both electrodes.

A bit division process is performed as below. In order to represent 64 ($6^{th}$ power of 2) gray scale levels, image data having a 6-bit width is required. Thus, here, the image data is divided into higher 3 bits and lower 3 bits (however, the present invention is not limited thereto).

Both the higher bits and the lower bits are respectively 3 bits, and thus 8 reference voltage levels (gray scale voltage levels) are required for each one of the higher bits and the lower bits, and a total of 16 reference voltage levels are required. Accordingly, the number of reference voltage levels can be configured to be ¼ times "64" that is generally used.

The 64 types of gray scale levels can be freely represented by selecting one from among a first reference voltage group and one from among a second reference voltage group and acquiring a difference therebetween.

Here, the voltage level selected from among the first reference voltage group is Da(i), and the voltage level selected from among the second reference voltage group is Db(i).

For example, when Da(i) is applied to one electrode 2*a* of the liquid crystal LC, Db(i) is applied to the other electrode 2*b*. Accordingly, a gray scale voltage level of "Da(i)-Db(i)" is applied to the liquid crystal LC, and transmittance corresponding to a wanted gray scale level can be implemented.

Internal Configuration of Gray Scale Driving Voltage Generating Circuit

According to an embodiment of the invention, the gray scale voltage level corresponding to the higher bits and the gray scale voltage level corresponding to the lower bits are required to be separately generated.

Figure 7:
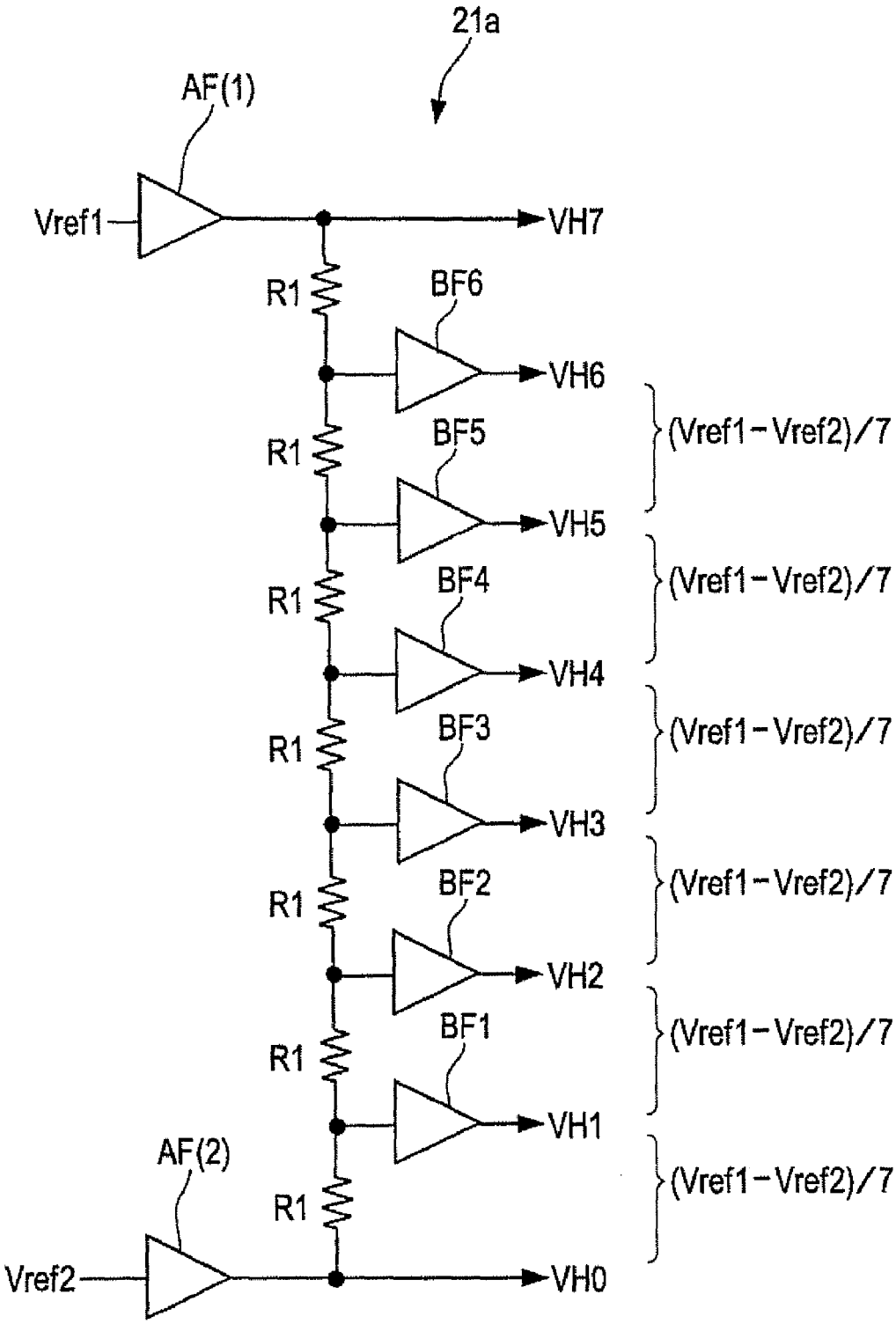
FIG. 7 is a circuit diagram showing a basic configuration of a gray scale voltage generating circuit for higher bits according to an embodiment of the invention.
Figure 8:
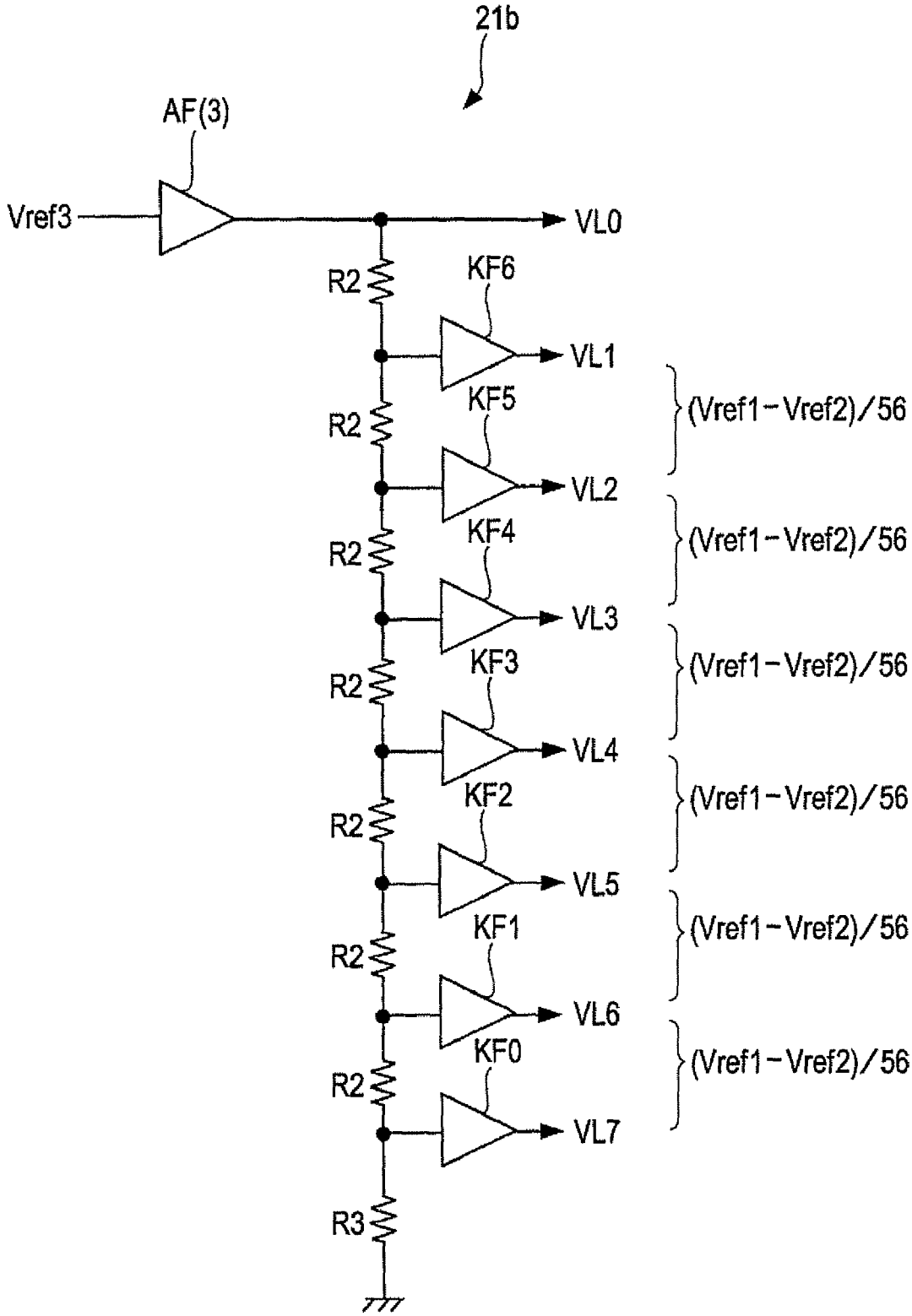
FIG. 8 is a circuit diagram showing a basic configuration of a gray scale voltage generating circuit for lower bits according to an embodiment of the invention.

FIG. 7 is a circuit diagram showing an example (using a ladder resistors) of the configuration of a gray scale voltage generating circuit for the higher bits according to an embodiment of the invention which generates a gray scale voltage level corresponding to the higher bits. FIG. 8 is a circuit diagram showing an example (using a ladder resistors) of the configuration of a gray scale voltage generating circuit for the lower bits according to an embodiment of the invention which generates a voltage level corresponding to the lower bits.

As shown in the figure, the gray scale voltage generating circuit 21*a* for the higher bits and the gray scale voltage generating circuit 21*b* for the lower bits have ladder resistors having a configuration that a plurality of resistors are connected in series between reference voltages, and required gray scale voltage levels are generated by drawing out divided voltage levels from voltage divided points of the ladder resistors. Accordingly, simplification of the configuration of the circuit and effective generation of a plurality of gray scale voltage levels in a speedy manner can be made.

One from among the plurality of the generated gray scale voltage levels is selected by a switching circuit. When an analog switch or the like is used as the switching circuit, a required gray scale voltage level can be precisely selected in a speedy manner (this aspect will be described later).

Since 64 gray scale levels are represented by using a range represented by Von and Voff shown in FIG. 6 which can be seen to be linear, the gray scale voltage generating circuit 21*a* for the higher bits shown in FIG. 7 generates 8 gray scale voltage levels $VH_0$ to $VH_7$ having equal electric potential differences therebetween by diving a distance between two reference voltage levels Vref1 and Vref2 into seven divisions by using 7 ($=2^3-1$) voltage-dividing resistors R1.

In the circuit shown in FIG. 7, since the reference voltage level Vref2 can be directly used as the gray scale voltage level $VH_0$, one gray scale voltage level is already acquired, and thus the distance between Vref1 and Vref2 is divided into $2^3-1$.

The gray scale voltage generating circuit 21*b* for the lower bits shown in FIG. 8 divides Vref3 by using 8(=$2^3$) voltage-dividing resistors. In FIG. 8, a voltage-dividing resistor that is grounded is represented by R3, and other voltage-dividing resistors are represented by R2. Accordingly, 8 gray scale voltage levels ($VL_0$ to $VL_7$) having equal electric potential differences are generated.

The configurations of the gray scale voltage generating circuits shown in FIGS. 7 and 8 are merely examples, and the invention is not limited thereto, and various modifications or applications can be made therein.

Here, Vref3 is a voltage level corresponding to a difference ($VH_p-VH_{p-1}$ where p is one of 1 to 7) between the gray scale voltage level $VH_0$ to $VH_7$ for the higher bits which are shown in FIG. 7 and a voltage level of an adjacent gray scale voltage.

Accordingly, the gray scale voltage generating circuit 21*b* shown in FIG. 8 generates the gray scale voltage levels $VL_0$ to $VL_7$ having equal electric potential differences generated by equally dividing a distance between two reference voltage levels Vref1 and Vref2 by 56 (7×8).

Thus, for the gray scale voltage levels $VL_0$ to $VL_7$ for the lower bits, a relationship equation of $(VH_p-VH_{p-1})/8$ (=$2^3$)=(Vref1−Vref2)/56 where a difference ($(VL_s-VL_{s-1})$ where s is one of 1 to 7) between adjacent gray scale voltage levels is satisfied.

In order to implement 64 gray scale levels using a range Von to Voff shown in FIG. 6 which appears to be linear, reference voltages Vref1 to Vref3 are set so as to satisfy the following two equations.

$$(V\text{ref1}-V\text{ref2})=8/9(V\text{on}-V\text{off})$$

$$(V\text{ref2}-V\text{ref3})=V\text{off}$$

In FIGS. 7 and 8, AF(1) to AF(3) denote buffers for supplying the reference source voltage levels Vref1 to Vref3. In addition, BF0 to BF6 and KF0 to KF6 are ladder resistors or buffers for outputting acquired divided voltage levels. When additional current driving capability is not necessary, these buffers may not be used.

An example of selection of gray scale voltage levels in a case where the gray scale levels are represented by using the gray scale voltage generating circuits 21*a* and 21*b* shown in FIGS. 7 and 8 is as follows.

1/64 gray scale level: $VH_0$ and $VL_0$

2/64 gray scale level: $VH_0$ and $VL_1$

.

.

7/64 gray scale level: $VH_0$ and $VL_7$

8/64 gray scale level: $VH_1$ and $VL_0$

9/64 gray scale level: $VH_1$ and $VL_1$

Internal Configuration of Output Circuit

Figure 9:
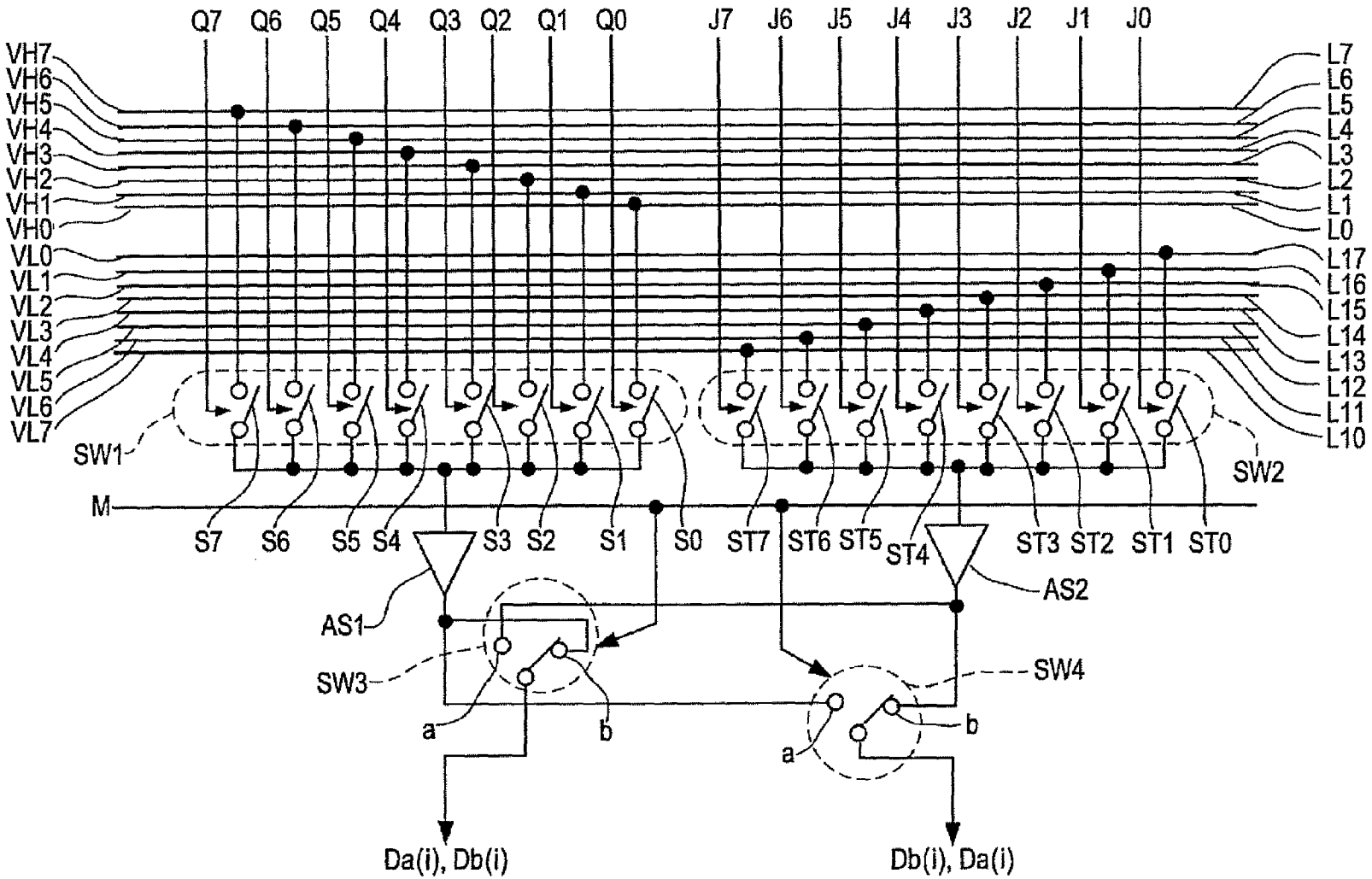
FIG. 9 is a circuit diagram showing the internal configuration of an output circuit disposed in a data line driving circuit according to an embodiment of the invention.

FIG. 9 is a circuit diagram showing the circuit configuration of a part, which corresponds to one pixel, of an output circuit according to an embodiment of the invention which is disposed in the data line driving circuit.

As shown in the figure, the output circuit 27 disposed in the data line driving circuit 30 selects and outputs one from among gray scale voltage levels $VH_0$ to $VH_7$ (Da(i)) of the first group and selects and outputs one from among gray scale voltage levels $VL_7$ to $VL_0$ (Db(i)) of the second group.

As shown in FIG. 9, the gray scale voltage levels $VH_0$ to $VH_7$ (Da(i)) of the first group are applied to lines L0 to L7, and the gray scale voltage levels $VL_7$ to $VL_0$ (Db(i)) of the first group are applied to lines L10 to L17.

In order to select one from among the gray scale voltage levels $VH_0$ to $VH_7$ (Da(i)) of the first group, a switch SW1 having unit switches S0 to S7 is disposed. The unit switches S0 to S7 are appropriately switched in accordance with switch control signals Q0 to Q7 transmitted from the control circuit 9.

In addition, in order to select one from among the gray scale voltage levels $VL_7$ to $VL_0$ (Db(i)) of the second group, a switch SW2 having unit switches $ST_7$ to $ST_0$ is disposed. The unit switches $ST_7$ to $ST_0$ are appropriately switched in accordance with switch control signals J7 to J0 transmitted from the control circuit 9.

The one selected from among the gray scale voltage levels $VH_0$ to $VH_7$ by the switch SW1 is supplied to an output buffer AS1 (may be omitted). In addition, the one selected from among the gray scale voltage levels $VL_7$ to $VL_0$ of the second group by the switch SW2 is supplied to an output buffer AS2 (may be omitted).

To output terminals of the output buffers AS1 and AS2, a switch SW3 and a switch SW4 which are used for switching output paths are connected.

As described above, it is preferable that prevention of burn-in and reduction of the effect of feed-through (see FIG. 14) is achieved by shifting the gray scale voltages Da(i) and Db(i) supplied to the electrodes 2*a* and 2*b* of one pixel, for example, for each frame period (1V period). In order to implement the shift between the gray scale voltages, switches SW3 and SW4 are disposed.

Whether the switch SW3 is connected to a terminal "a" or a terminal "b" is controlled by a polarity shift signal M transmitted from the control circuit 9. Similarly, whether the switch SW4 is connected to a terminal "a" or a terminal "b" is controlled by a polarity shift signal M transmitted from the control circuit 9. Accordingly, whether output signals of the output buffers AS1 and AS2 are output through the switch SW3 or the switch SW4 can be arbitrary determined. As describe above, the gray scale voltages Da(i) and Db(i) (or Db(i) or Da(i)) to be supplied to the electrodes 2*a* and 2*b* of one pixel are output to one pair of data lines DL.

The output buffers AS1 and AS2 may be disposed next to the switches SW3 and SW4, and may be omitted in a case where current driving capability is not required.

As described above, in order to reduce the flicker, it is preferable that the relationships between Da(i) and Db(i) and the output buffers AS1 and AS2 are set to be opposite to each other in adjacent pixels.

As described above, in the configuration shown in FIG. 9, a total 18 of unit switches (8 switches of S0 to S7, 8 switches of $ST_0$ to $ST_7$, and 2 switches of SW3 and SW4) are used for each pixel. In addition two output buffers AS1 and AS2 are used for each pixel (however, there is a case where the output buffers can be omitted).

In the data line driving circuit (data line driving IC) 30 shown in FIG. 5, a total 16 of voltage buses $VH_7$ to $VH_0$ and $VL_7$ to $VL_0$ are wired along a long side thereof, and 18×m (where m is the number of pixels in the scanning line direction) switches and 2×m output buffers (may be omitted) are disposed.

In order to implement the same configuration by using a known method, 64 voltage buses, 64×m switches, and m output buffers are required. Accordingly, according to this embodiment, it is possible to markedly simplify the data line driver.

In addition, since the range of gray scale voltage levels corresponding to the lower bits is small in the gray scale voltage generating circuit 21*b* for the lower bits, the reference voltage source Vref3 may be set to be lower than the reference source voltage Vref1 of the gray scale voltage generating circuit 21*a* for the higher bits.

In other words, since Vref1>Vref3, and Vref3 has a low voltage level, transistors constituting the output buffer (AF(3) shown in FIG. 8) of the gray scale voltage generating circuit 21*b* may be configured by low withstand-voltage transistors. Accordingly, reduction of the size of the transistors (reduction of the area occupied by the IC) can be achieved.

In addition, since the source voltage level of the output buffer AF(3) can be lowered, and thereby it is possible to reduce power consumption thereof.

In addition, the transistors constituting the switches SW2 ($ST_0$ to $ST_7$) shown in FIG. 9 and the output buffer AS2 can be configured by low withstand-voltage transistors. Thereby, reduction of the size of the transistors (reduction of the area occupied by the IC) can be achieved.

In addition, the source voltage level of the output buffer AS2 can be lowered. Thereby, it is possible to reduce power consumption thereof.

Second Embodiment

In this embodiment, an aspect in a case where gray scale data of plural bits is divided into higher bits and lower bits and a plurality of gray scale voltages corresponding to the higher bits and the lower bits are generated will be considered in detail.

Consideration of Bit Division

Hereinafter, a case where the total number of bits of the gray scale data is even and a case where the total number of bits of the gray scale data is odd will be considered separately.

(1) Case where Total Number of Bits of Gray Scale Data is Even (that is, 2k Bits (where k is a Natural Number Equal to or Larger Than One))

There are various methods of dividing higher bits and lower bits, and the method is not limited to a method described below. However, it is the most efficient to equally divide the higher bits and the lower bits into k-bits each for 2k bit (k is a natural number equal to or larger than 1) gray scale data. In such a case, the number of gray scale voltage levels determined by the higher bits is equal to that determined by the lower bits, and thereby it becomes easy to implement a symmetrical circuit. In addition, since the numbers of higher-bit switches and lower-bit switches which are used for selecting one from among the plurality of gray scale voltage levels become the same, the configuration of the circuit becomes symmetrical, and thereby it becomes easy to implement the most compact layout of the circuit.

In other words, the gray scale voltage generating circuit 21*a* for the higher bits and the gray scale voltage generating circuit 21*b* for the lower bits can be configured to be equivalent circuits. In addition, since the numbers of higher-bit unit switches S0 to S7 and lower-bit unit switches ST0 to ST7, disposed in the output circuit 27, which are used for selecting one from among the plurality of gray scale voltage levels become the same, the configuration of the circuit becomes symmetrical, and thereby it becomes easy to implement the most compact layout of the circuit.

In addition, as described above, in the data line driving circuit 30, "$2^k$×2+2" switches and two output buffers (can be omitted) are disposed for each pixel. Accordingly, the number of switches markedly decreases, compared to a case where a known method is used.

For example, as in the above-described example, when 64 gray scale levels ($6^{th}$ power of 2) are to be implemented, 6 bits are equally divided (that is, the gray scale data is divided into three bits each). The lower bits are responsible for a range of 8 ($3^{rd}$ power of 2) gray scale levels, and the higher bits are responsible for a range of 56 (64−8) gray scale levels.

The range of 8 gray scale levels for which the lower bits are responsible is more minutely 8 (=$2^k$)-divided, and 8 voltage levels corresponding to the minutely divided gray scale levels become the gray scale voltages output by the gray scale voltage generating circuit 21*b* for the lower bits.

The range of 56 gray scale levels for which the higher bits are responsible is 7 (=$2^k$−1)-divided, and 8 gray scale voltage levels (the gray scale voltages output by the gray scale voltage generating circuit 21*a* for the higher bits) are acquired.

The description above can be generalizes as below. When the required number of gray scale levels is set to $Z^2$, Z is acquired from calculating the square root of the number of gray scale levels. Z is the gray scale range of the lower bits, and the gray scale range for the higher bits becomes "$Z^2$−Z". The gray scale range for the lower bits is also Z-divided, and accordingly, Z gray scale voltages (reference voltages) output by the gray scale voltage generating circuit 21*b* for the lower bits are determined. In addition, the gray scale range for the higher bits is also (Z−1)-divided, and accordingly, Z gray scale voltages output by the gray scale voltage generating circuit 21*a* for the higher bits are determined.

The description above can be summarized as follows.

When the total number of bits of the gray scale data is even (that is, 2k bits (where k is a natural number equal to or larger than one)) and an equal-bit dividing method (a method in which the gray scale data is divided into k bits each) is used, the data line driving circuit 30 shown in FIG. 1 generates $2^k$ gray scale voltages VH0 to $VH_{2^k-1}$ (Da(i)), which have equal voltage differences, corresponding to the higher bits by ($2^k$−1) dividing voltages corresponding to the gray scale range determined by the k higher bits.

In addition, when the gray scale voltages corresponding to the higher bits are represented by VHp (where p is an integer in the range of 1 to $2^k$−1) and the gray scale voltages corresponding to the lower bits are represented by VLs (where s is an integer in the range of 1 to $2^k$−1), $2^k$ gray scale voltages $VL_0$ to $VL_{2^k-1}$ (Db(i)), which have equal voltage differences therebetween and satisfy the voltage relationship of "$VL_s-VL_{s-1}=(VH_p-VH_{p-1})/2^k$", corresponding to the lower bits are generated.

In addition, the data line driving circuit 30 selectively turns on one from among $2^k$ switches $S_0$ to $S_{2^k-1}$ disposed in correspondence with the gray scale voltages $VH_0$ to $VH_{2^k-1}$ (Da(i)) for the higher bits and supplies the selected gray scale voltage $VH_0$ to $VH_{2^k-1}$ (Da(i)) for the higher bits to the first data line or the second data line.

In addition, the data line driving circuit 30 selectively turns on one from among $2^k$ switches $ST_0$ to $ST_{2^k-1}$ disposed in correspondence with the gray scale voltages $VL_0$ to $VL_{2^k-1}$ (Db(i)) for the lower bits and supplies the selected gray scale voltage $VL_0$ to $VL_{2^k-1}$ (Db(i)) for the lower bits to the second data line or the first data line.

(2) Case where Total Number of Bits of Gray Scale Data is Odd (2k−1 Bits)

In such a case, there are various bit dividing methods, and the method is not limited to a method described below. However, it is preferable that the method described below is used.

For example, it is preferable that the gray scale data is divided into k higher bits and "k−1" lower bits, In addition, it is preferable that the gray scale data is divided into "k−1" higher bits and k lower bits.

By dividing the gray scale data such that the number of the higher bits is close to the number of the lower bits, the numbers of selection switches for the higher bits and the lower bits can be minimized. In addition, since a difference between the numbers of switches is also minimized, it becomes easy to dispose the switches with high density, and therefore there is an advantage for layout.

In other words, when the gray scale data is divided into k higher bits and "k−1" lower bits, the data line driving circuit 30 generates $2^k$ gray scale voltages $VH_0$ to $VH_{2^k-1}$ (Da(i)), which have equal voltage differences therebetween, corresponding to the higher bits by $2^k-1$ dividing the voltage level corresponding to the gray scale range determined by k higher bits.

In addition, when the gray scale voltages corresponding to the higher bits are represented by VHp (where p is an integer in the range of 1 to $2^k-1$) and the gray scale voltages corresponding to the lower bits are represented by $VL_s$ (where s is an integer in the range of 1 to $2^{(k-1)}-1$) $2^{(k-1)}$ gray scale voltages $VL_0$ to $VL_{(2^{(k-1)}-1)}$ (Db(i)), which have equal voltage differences therebetween and satisfy the voltage relationship of "$VL_s-VL_{s-1}=(VH_p-VH_{p-1})/2^{(k-1)}$", corresponding to the lower bits are generated.

Then, the data line driving circuit 30 selectively turns on one from among $2^k$ switches $S_0$ to $S_{(2^k-1)}$ disposed in correspondence with the gray scale voltages $VH_0$ to $VH_{2^k-1}$ (Da(i)) for the higher bits and supplies the selected gray scale voltage $VH_0$ to $VL_{(2^k-1)}$ (Da(i)) for the higher bits to the first data line or the second data line. In addition, the data line driving circuit 30 selectively turns on one from among $2^{(k-1)}$ switches $ST_0$ to $ST_{(2^{(k-1)}-1)}$ disposed in correspondence with the gray scale voltages $VL_0$ to $VL_{(2^{(k-1)}-1)}$ (Db(i)) for the lower bits and supplies the selected gray scale voltage $VL_0$ to $VL_{(2^{(k-1)}-1)}$ (Db(i)) for the lower bits to the second data line or the first data line.

Similarly, when the gray scale data is divided into "k−1" higher bits and k lower bits, the data line driving circuit 30 generates $(2^{(k-1)}-1)$ gray scale voltages $VH_0$ to $VH_{(2^{(k-1)}-1)}$ (Da(i)), which have equal voltage differences therebetween, corresponding to the higher bits by $2^{(k-1)})-1$ dividing the voltage level corresponding to the gray scale range determined by "k−1" higher bits.

In addition, when the gray scale voltages corresponding to the higher bits are represented by $VH_p$ (where p is an integer in the range of 1 to $2^{(k-1)}-1$) and the gray scale voltages corresponding to the k-bit lower bits are represented by $VL_s$ (where s is an integer in the range of 1 to $2^k-1$), $2^k$ gray scale voltages $VL_0$ to $VL_{(2^k-1)}$ (Db(i)), which have equal voltage differences therebetween and satisfy the voltage relationship of "$VL_s-VL_{s-1}=(VH_p-VH_{p-1})/2^k$", corresponding to the lower bits are generated.

Then, the data line driving circuit 30 selectively turns on one from among $2^{(k-1)}$ switches $S_0$ to $S_{2^{(k-1)}-1)}$ disposed in correspondence with the gray scale voltages $VH_0$ to $VH_{(2^{(k-1)}-1)}$ (Da(i)) for the higher bits and supplies the selected gray scale voltage $VH_0$ to $VH_{(2^{(k-1)}-1)}$ (Da(i)) for the higher bits to the first data line or the second data line.

In addition, the data line driving circuit 30 selectively turns on one from among $2^k$ switches $ST_0$ to $ST_{(2^k-1)}$ disposed in correspondence with the gray scale voltages $VL_0$ to $VL_{(2^k-1)}$ (Da(i)) for the lower bits and supplies the selected gray scale voltage $VL_0$ to $VL_{(2^k-1)}$ (Db(i)) for the lower bits to the second data line or the first data line.

Third Embodiment

Although the liquid crystal has been described to have an ideally linear property in the first embodiment, it is difficult for the electro-optical characteristic of a practical liquid crystal to be linear.

Practically, several types of γ curves (γ correction characteristic) are generally shifted to be used. In addition, there are many cases where a same data line driving circuit is commonly used for several types of liquid crystals having different electro-optical characteristics and the characteristic of the data line driving circuit is delicately adjusted in practical use.

In addition, there is a case where, for example, 256 gray scale levels instead of 64 gray scale levels are required. Furthermore, since electro-optical characteristic differs for each color of RGB, there is a case where a different electrical potential is used for each color.

In such a case, when a known method (a method in which gray scale voltages and switches corresponding to the required number of gray scale levels are disposed and one of the gray scale voltages is selected by turning one of the switches), even in a case where one type of the liquid crystal is used, for example, "256×3 (RGB)×number of γ types" voltage buses and "256×m×number of γ types" switches are needed, and accordingly, the scale of the data line driving circuit 30 becomes too vast to be practically implemented.

Furthermore, frame rate control (FRC: a method of representing the number of colors which is larger than an actual displayable number of colors) may be considered to be used. However, when the frame rate control is used, it is difficult to respond to a motion picture with high speed of around 60 fps.

Even in such a case, according to an embodiment of the invention, it is possible to respond to the problem in a relatively easy manner. In other words, according to an embodiment of the invention, even in a case where the number of gray scale levels increases, the configuration of the data line driving circuit can be adjusted to a practical level.

Accordingly, even when the number of gray scale levels is converted (the number of gray scale levels is increases) for responding to a delicate non-linear property of the liquid crystal, for example, by using a lookup table, the scale of the data line driving circuit 30 does not increase so much.

Figure 10:
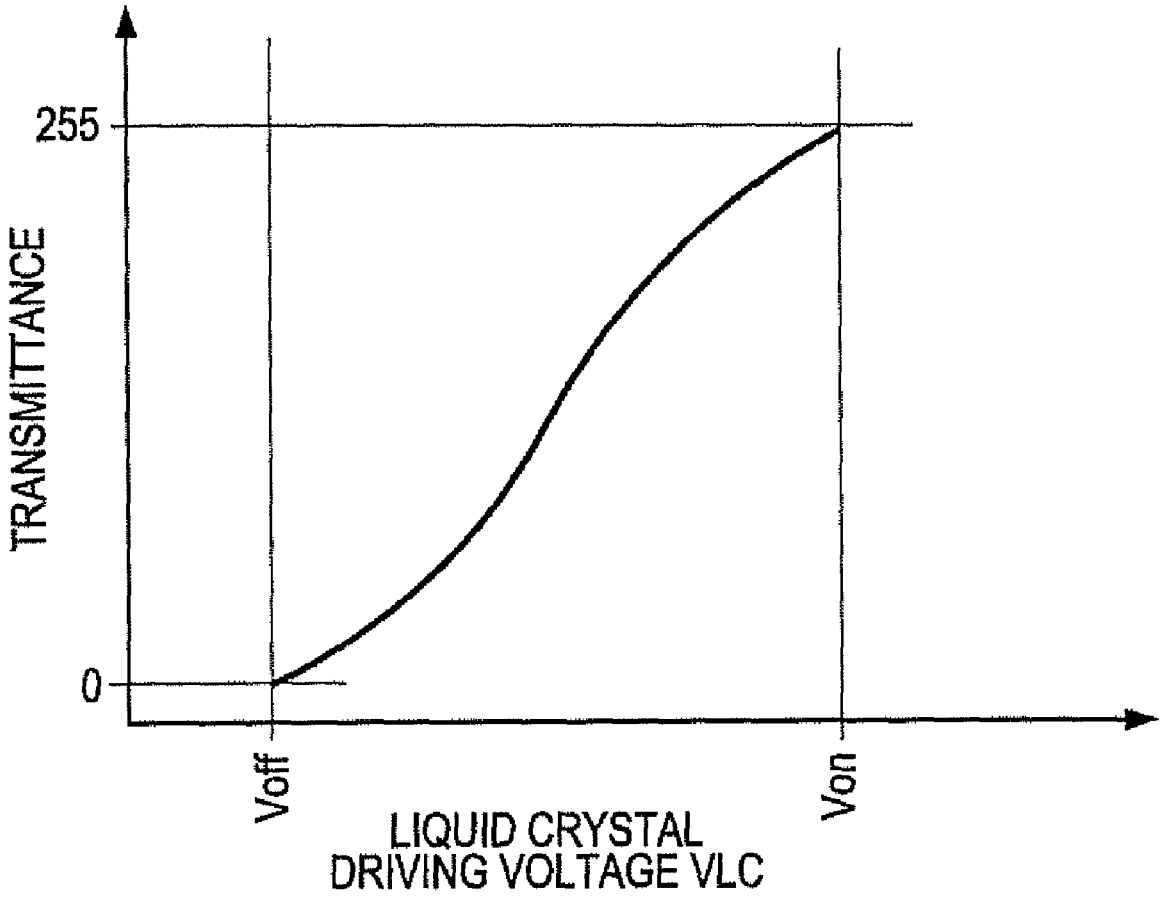
FIG. 10 is a diagram showing another example (example in which a linear area is not included) of the electro-optical characteristic of a liquid crystal.
Figure 13:
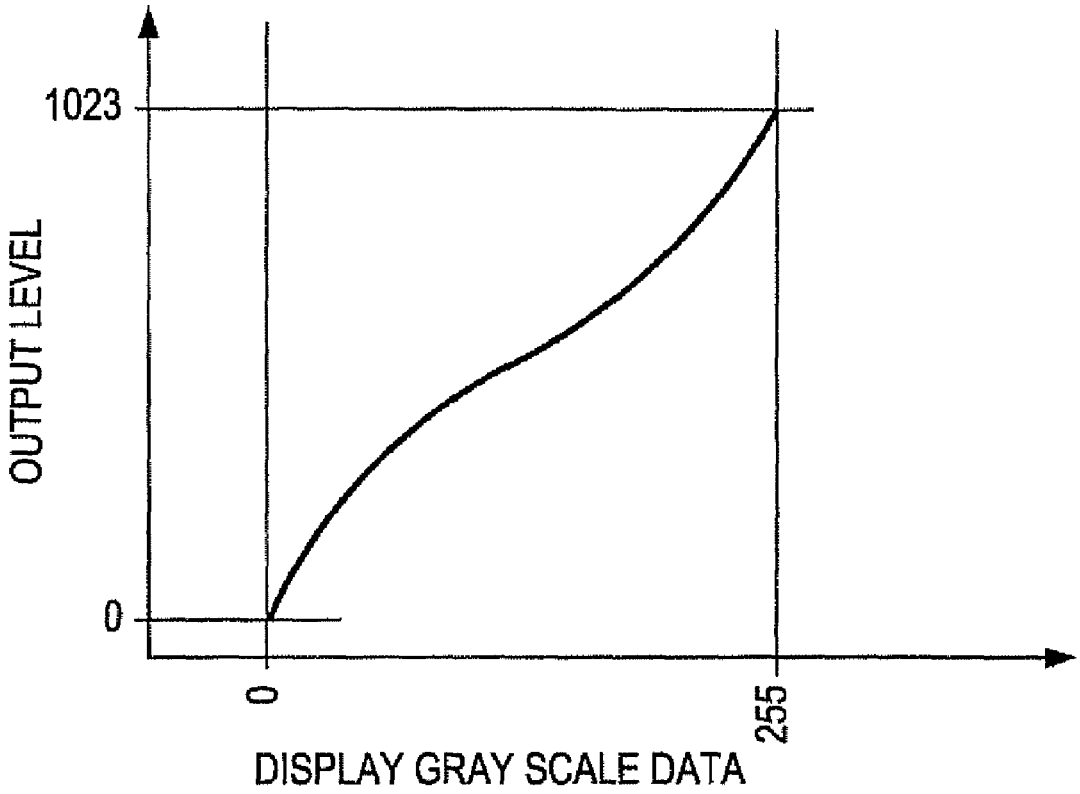
FIG. 13 is a diagram showing relationship between display gray scales and output voltage levels according to an embodiment of the invention.

In descriptions below, a liquid crystal having the non-linear electro-optical characteristic as shown in FIG. 10 will be considered. In order to respond to the non-linear electro-optical characteristic as shown in FIG. 10, the relationship between the output voltage and the display gray scale data in the data line driving circuit 30, as shown in FIG. 13, is required to have a characteristic opposite to that of the liquid crystal.

Figure 11:
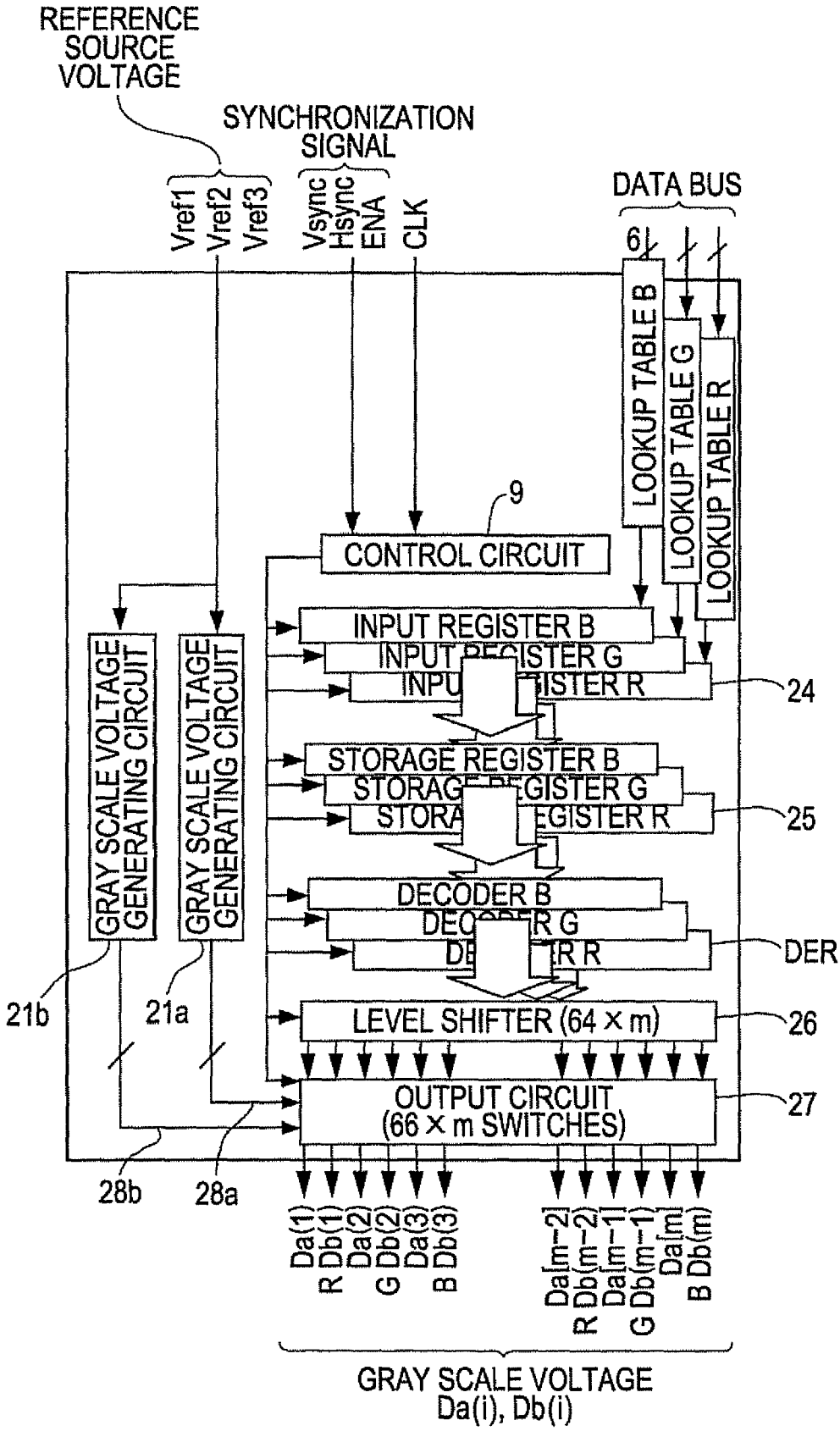
FIG. 11 is a block diagram showing the configuration of a data line driving circuit (data line driving IC) according to a third embodiment of the invention.

FIG. 11 is a block diagram showing the configuration of a data line driving circuit of an active matrix-type liquid crystal device according to a third embodiment of the invention. In FIG. 11, to a common part described with reference to the above-described drawings, a same reference number is attached. In the data line driving circuit 30 shown in FIG. 11, lookup tables and decoders for each color of RGB are included in addition to the configuration shown in FIG. 5.

In the liquid crystal device shown in FIG. 11 according to this embodiment, in order to respond to the above-described request, the actual number of display gray scale levels (set to 264) is converted, for example, into the number (=1024) of the gray scale levels which is acquired by multiplying the actual number of the gray scale levels by four.

For example, by using a lookup table (in this table, data is adjusted for acquiring a γ characteristic opposite to the electro-optical characteristic of the liquid crystal shown in FIG. 10) as shown in FIG. 12, image data of 256 gray scale levels for each color of RGB is mapped into 1024 levels.

As described above, gray scale voltages (having same electric potential differences) corresponding to the substantial 1024 gray scale levels are individually generated by the gray scale voltage generating circuit 21*a* responsible for the higher bits and the gray scale voltage generating circuit 21*b* responsible for the lower bits, and the gray scale voltages are applied to the pixel electrodes 2*a* and 2*b* of each pixel, and desired gray scale display is implemented by using a difference (a difference voltage level between the gray scale voltages corresponding to the higher bits and the lower bits) of the voltages applied to the electrodes.

Hereinafter, the bit division process in the liquid crystal device shown in FIG. 11 will be considered in detail. The number of the gray scale levels after the gray scale conversion process is 1024 ($10^{th}$ power of 2) and 10-bit image data is formed. Accordingly, the image data is equally divided into the higher bits and the lower bits, and image data each having 5 bits is formed.

The lower bits are responsible for the range of 32 (=$5^{th}$ power of 2) gray scale levels, and the higher bits are responsible for the range of 992 (=1024−32) gray scale levels.

The gray scale voltage generating circuit 21*a* for the higher bits 31 (=32−1)-divides the source voltage corresponding to the range of the 992 gray scale levels and generates 32 gray scale voltages for 32 higher bits. In addition, the gray scale voltage generating circuit 21*b* for the lower bits 32-divides the voltage corresponding to the range of the 32 gray scale levels and generates 32 gray scale voltages.

In the level shifter 26, 64 (=32×2) level shift circuits for each pixel are disposed. When the number of pixels connected to one scanning line is m, the number of the level shift circuits becomes "64×m".

In addition, the number of the switches of the output circuit 27 for each pixel becomes 66 (32×2+2). When the number of pixels connected to one scanning line is m, the total number of the switches becomes "66×m".

Figure 15:
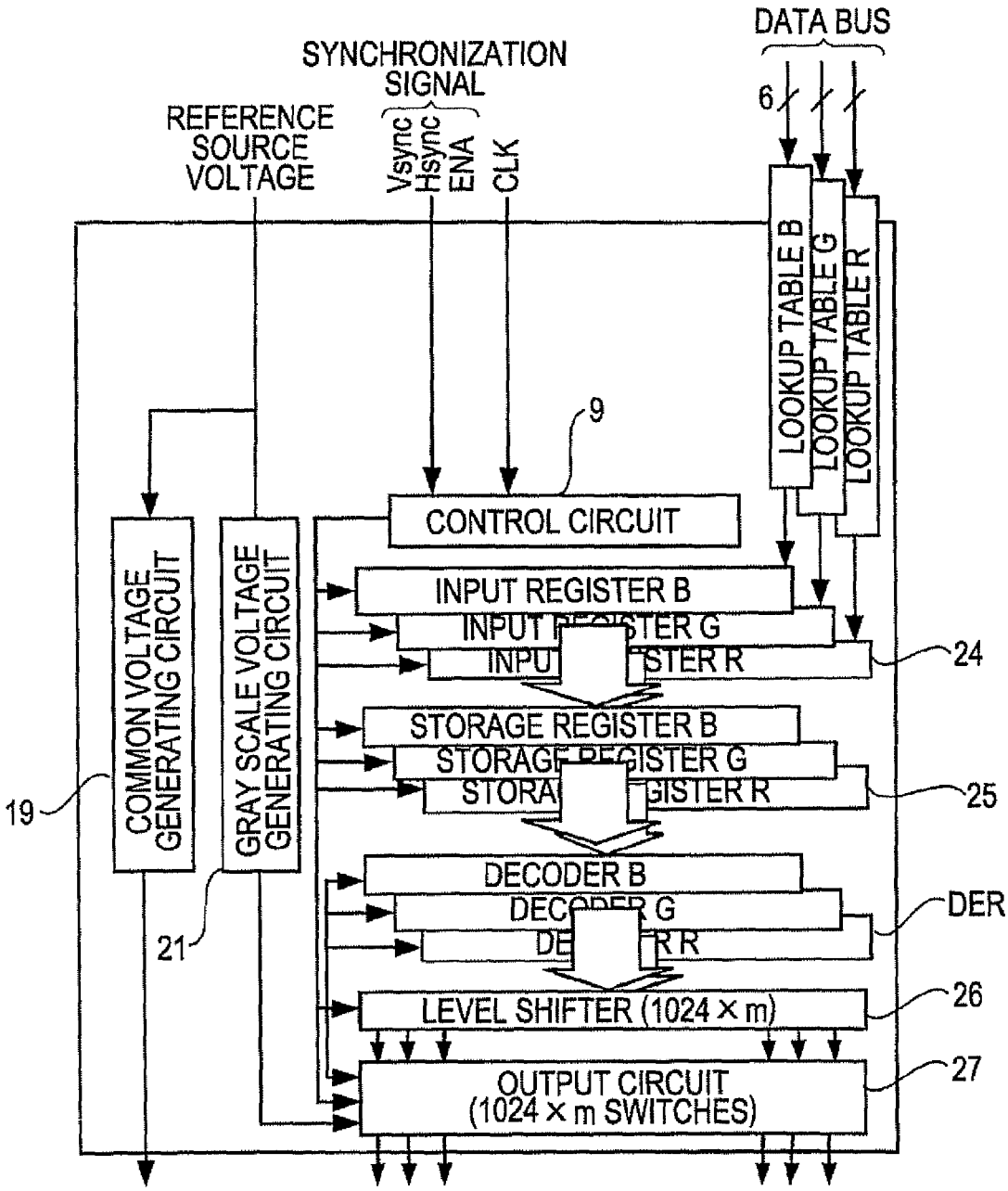
FIG. 15 is an example of the configuration of a known liquid crystal device in a case where 1024 gray scale levels are implemented.

The configuration of a known liquid crystal device is shown in FIG. 15. In the known liquid crystal device of FIG. 15, 1024 voltage buses, "1024×m" switches, 3 series of lookup tables each having 256 bits×10 bits, 1024×m level shifters are required, and thus a very large-scaled circuit is needed.

In the liquid crystal device according to an embodiment of the invention shown in FIG. 11, the data line driving circuit 30 can be constituted by 64 voltage buses, "66×m" switches, 3 series of lookup tables each having 256 bits×10 bits, and "64×m" level shifters. Accordingly, the configuration of the circuit can be markedly simplified.

In this embodiment, although the decoder DER is disposed between the storage register 25 and the level shifter 26, however, the present invention is not limited thereto. Thus, the decoder may be disposed between the input register 24 and the storage register 25 or between the level shifter 26 and the output circuit 27.

In addition, in a case where cancellation of feed-through is insufficient, a polarity difference can be corrected by disposing an adder prior to a previous decoder and adding or not adding a value according to the polarity.

Fourth Embodiment

In this embodiment, an example of an electronic apparatus in which an active matrix-type liquid crystal device (electro-optical device) according to an embodiment of the invention is installed will be described.

Projector

Figure 16:
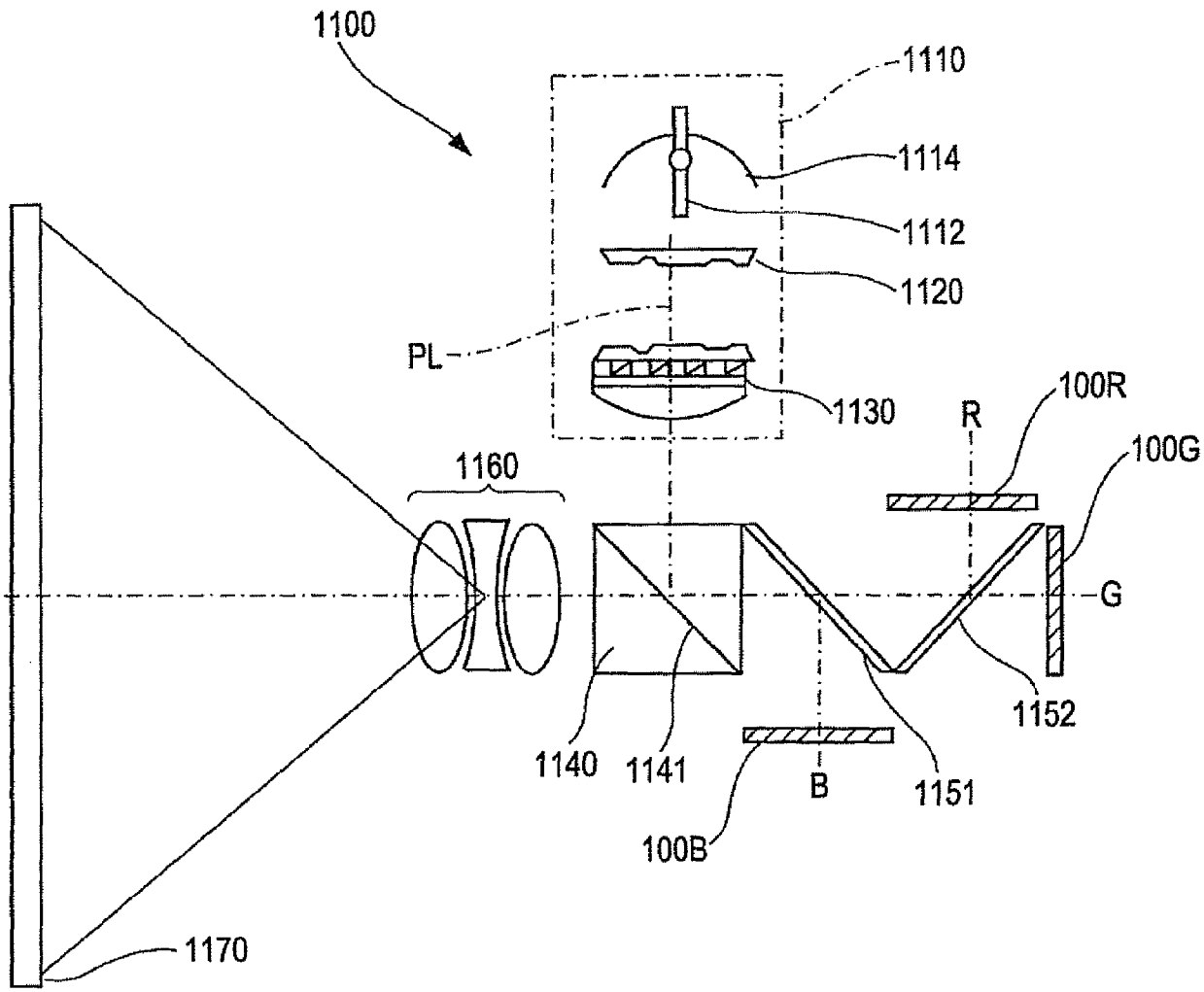
FIG. 16 is a diagram showing the whole configuration of a projector including an electro-optical device according to an embodiment of the invention.

First, a projector in which an electro-optical device according to an embodiment of the invention is used as a light valve will be described. FIG. 16 is a diagram showing the whole configuration of a projector including an electro-optical device (reflection-type liquid crystal device) according to an embodiment of the invention.

As shown in the figure, inside the projector 1100, a polarized lighting device 1110 is disposed along the optical axis PL of the system. In the polarized lighting device 1110, light emitted from a lamp 1112 becomes light fluxes substantially parallel to one another due to reflection of a reflector 1114, and the light fluxes are incident to a first integrator lens 1120. Accordingly, the light emitted from the lamp 1112 is divided into a plurality of intermediate light fluxes. These divided intermediate light fluxes are converted into one type of polarized light fluxes (s polarized light fluxes) having a substantially-constant polarized direction by a polarization conversion element 1130 having a second integrator lens disposed on the light incident side and are emitted from the polarized lighting device 1110.

The s-polarized light fluxes emitted from the polarized lighting device 1110 are reflected by an s-polarized light flux reflecting surface 1141 of a polarization beam splitter 1140. Among these reflected light fluxes, light fluxes of blue light B are reflected by a blue light reflecting layer of a dichroic mirror 1151 and are modulated by a reflection-type electro-optical device 100B. In addition, among the light fluxes transmitted through the blue light reflecting layer of the dichroic mirror 1151, light fluxes of red light R are reflected by a red light reflecting layer of a dichroic mirror 1152 and are modulated by a reflection-type electro-optical device 100R.

In addition, among the light fluxes transmitted through the blue light reflecting layer of the dichroic mirror 1151, light fluxes of green light G are transmitted through the red light reflecting layer and are modulated by a reflection-type electro-optical device 100G.

As described above, the light fluxes of the red light, the green light, and the blue light modulated by the electro-optical devices 100R, 100G, and 100B are sequentially composed by the dichroic mirrors 1152 and 1151 and the polarization beam splitter 1140 and are projected on a screen 1170 by a projection optical system 1160. Since light fluxes corresponding to the original colors of R, G, and B are incident to the electro-optical devices 100R, 100B, and 100G by the dichroic mirrors 1151 and 1152, a color filter is not needed.

Since the liquid crystal device according to an embodiment of the invention is configured to be simplified and miniaturized and is configured to have low power consumption and low cost, the same advantages as those of the liquid crystal device can be acquired by using the projector shown in FIG. 16, and accordingly, the projector is useful as a projector for a home theater. In the above-described example, the projector may use one between a reflection-type liquid crystal device and a liquid crystal device for projection-type display.

Mobile Computer

Figure 17:
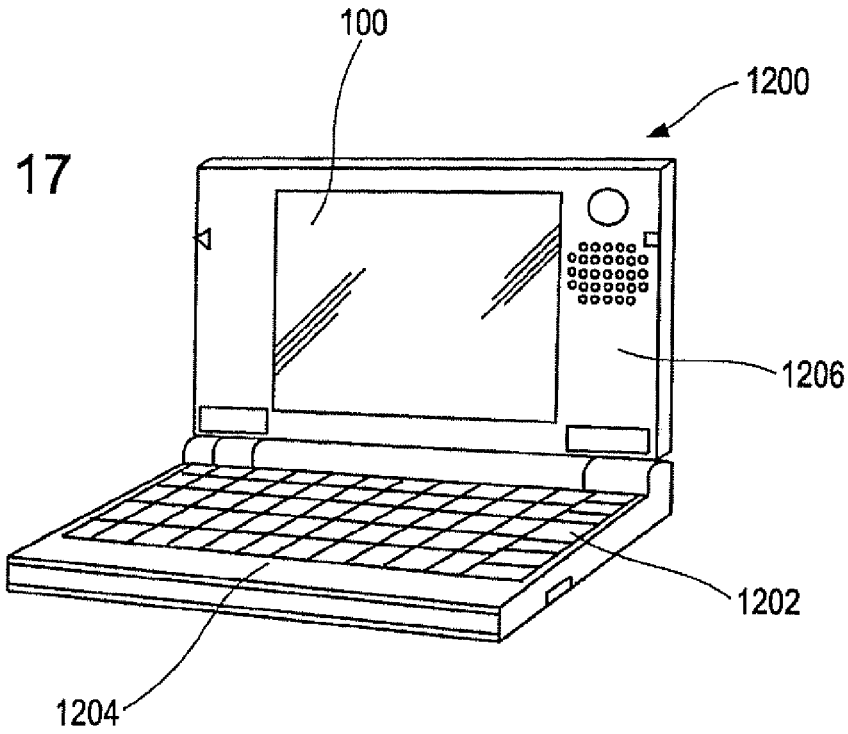
FIG. 17 is a perspective view showing the configuration of a personal computer including an electro-optical device according to an embodiment of the invention.

Next, an example in which a liquid crystal device (electro-optical device) according to an embodiment of the invention is used for a mobile personal computer will be described. FIG. 17 is a perspective view showing the configuration of a personal computer including an electro-optical device according to an embodiment of the invention.

In FIG. 17, a computer 1200 is constituted by a main unit 1204 having a keyboard 1201 and a display unit 1206. This display unit 1206 is configured by adding a front light on a front side of the above-described electro-optical device 100. Under this configuration, since the electro-optical device 100 is used as a reflection direct-view type, it is preferable that concaves and convexes are formed in pixel electrodes 118 for scattering reflected light in various directions.

Since the liquid crystal device according to an embodiment of the invention is configured to be simplified and miniaturized and is configured to have low power consumption and low cost, the same advantages as those of the liquid crystal device can be acquired by using the mobile computer shown in FIG. 17. In addition, since the liquid crystal device has a superior characteristic for low power consumption, there is an advantage that the durability of a battery can be improved.

Mobile Terminal

Figure 18:
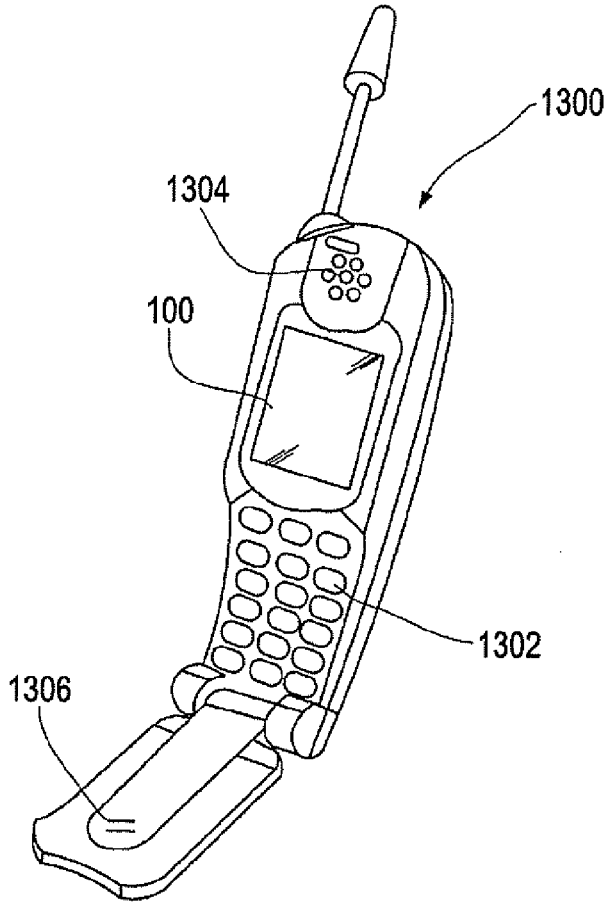
FIG. 18 is a perspective view showing the configuration of a mobile terminal having a liquid crystal device according to an embodiment of the invention.

FIG. 18 is a perspective view showing the configuration of a mobile terminal (here, a mobile phone) having a liquid crystal device according to an embodiment of the invention.

In the figure, the mobile phone 1300 has the electro-optical device 100 in addition to a plurality of operation buttons 1302, an earpiece 1304, and a mouthpiece 1305. On the front side of the electro-optical device 100, a front light is disposed as is needed. Under this configuration, since the electro-optical device 100 is used as a reflection direct-view type, it is preferable that concaves and convexes are formed in pixel electrodes 118 for scattering reflected light in various directions.

Since the liquid crystal device according to an embodiment of the invention is configured to be simplified and miniaturized and is configured to have low power consumption and low cost, the same advantages as those of the liquid crystal device can be acquired by using the mobile terminal shown in FIG. 18.

In addition, the present invention may be applied to other electronic devices (for example, a liquid crystal television set, a view finder-type or a monitor direct view-type video cassette recorder, a car navigation system, a pager, an electronic diary, a calculator, a word processor, a workstation, a video phone, a POS terminal, a device having a touch panel, or the like). According to an embodiment of the invention, a compact and low-cost liquid crystal device capable of high precision display (multiple gray scale level display) can be acquired.

As described above, according to an embodiment of the invention, the number of required electric potential-levels (gray scale voltages) can be remarkably reduced by dividing the gray scale data into higher bits and lower bits and applying the gray scale data to each pixel electrode as a difference between two data lines, and thereby the configuration of the data line driving circuit can be simplified.

In addition, since a variable range (dynamic range) of the gray scale voltages on the lower bit side is small, low withstand-voltage elements can be used in a circuit relating to generation of the gray scale voltages on the lower bit side, and the circuit can be operated at a low source voltage level. Therefore, miniaturization, low power consumption, and low cost of the data line driving circuit (and the liquid crystal device) can be achieved.

Although embodiments of the invention have been described in detail, it will be understood by those of ordinary skill in the art that various changes may be made therein without departing from new matters and advantages of the invention. Accordingly, such modified examples belong to the scope of the invention.

According to an embodiment of the invention, advantages that the data line driving circuit is simplified and reduction of the chip area and low power consumption of the data line driving IC are achieved can be acquired. Thus, the present invention is the most appropriate for use as a mobile terminal or the like which requires miniaturization, light weight, and low cost. In addition, the technical idea of the invention may be applied to different electro-optical apparatuses.

Accordingly, the present invention may be appropriately applied to a liquid crystal device, a driving circuit of a liquid crystal device, a method of driving a liquid crystal device, and an electronic apparatus.

The entire disclosure of Japanese Patent Application No. 2007-093098, filed Mar. 30, 2007 is expressly incorporated by reference herein.

What is claimed is:

1. A liquid crystal device comprising:

a plurality of pixels disposed in the shape of a matrix of n rows×m columns, where n and m are natural numbers equal to or larger than two;

n scanning lines;

2m data lines including pairs of a first data line and a second data line for each column of the plurality of pixels; and a data line driving circuit that generates a first gray scale voltage corresponding to higher bits acquired by dividing gray scale data of plural bits into the higher bits and lower bits and generates a second gray scale voltage corresponding to the lower bits, wherein each one of the plurality of pixels includes a first switching element and a second switching element which are controlled to be turned on or off by the scanning lines, a first pixel electrode to which the first or second gray scale voltage is alternatively supplied from the first data line through the first switching element, and a second pixel electrode to which the second or first gray scale voltage not supplied to the first pixel electrode is supplied from the second data line through the second switching element, and the data line driving circuit generates the first gray scale voltage corresponding to k higher bits acquired by dividing the gray scale data of 2k, where k is a natural number equal to or larger than one, bits into the k higher bits and k lower bits and generates the second gray scale voltage corresponding to the k lower bits.

2. A liquid crystal device comprising:

a plurality of pixels disposed in the shape of a matrix of n rows×m columns, where n and m are natural numbers equal to or larger than two;

n scanning lines;

2m data lines including pairs of a first data line and a second data line for each column of the plurality of pixels; and a data line driving circuit that generates a first gray scale voltage corresponding to higher bits acquired by dividing gray scale data of plural bits into the higher bits and lower bits and generates a second gray scale voltage corresponding to the lower bits, wherein each one of the plurality of pixels includes a first switching element and a second switching element which are controlled to be turned on or off by the scanning lines, a first pixel electrode to which the first or second gray scale voltage is alternatively supplied from the first data line through the first switching element, and a second pixel electrode to which the second or first gray scale voltage not supplied to the first pixel electrode is supplied from the second data line through the second switching element, and the data line driving circuit generates the first gray scale voltage corresponding to k higher bits acquired by dividing the gray scale data of 2k−1, where k is a natural number equal to or larger than two, bits into the k higher bits and k−1 lower bits and generates the second gray scale voltage corresponding to the k−1 lower bits.

3. A liquid crystal device comprising:

a plurality of pixels disposed in the shape of a matrix of n rows×m columns, where n and m are natural numbers equal to or larger than two;

n scanning lines;

2m data lines including pairs of a first data line and a second data line for each column of the plurality of pixels; and a data line driving circuit that generates a first gray scale voltage corresponding to higher bits acquired by dividing gray scale data of plural bits into the higher bits and lower bits and generates a second gray scale voltage corresponding to the lower bits, wherein each one of the plurality of pixels includes a first switching element and a second switching element which are controlled to be turned on or off by the scanning lines, a first pixel electrode to which the first or second gray scale voltage is alternatively supplied from the first data line through the first switching element, and a second pixel electrode to which the second or first gray scale voltage not supplied to the first pixel electrode is supplied from the second data line through the second switching element, and the data line driving circuit generates the first gray scale voltage corresponding to k−1 higher bits acquired by dividing the gray scale data of 2k−1, where k is a natural number equal to or larger than two, bits into the k−1 higher bits and k lower bits and generates the second gray scale voltage corresponding to the k lower bits.

4. The liquid crystal device according to claim 1, wherein the data line driving circuit generates $2^k$ gray scale voltages, which have equal voltage differences therebetween, corresponding to $2^k$ higher bits by performing a "$2^k-1$" dividing operation for a voltage corresponding to a gray scale range determined by the k higher bits and generates $2^k$ gray scale voltages corresponding to the lower bits which have equal voltage differences therebetween and satisfy voltage relationship of "$VL_s-VL_{(s-1)}=(VH_p-VH_{(p-1)})/2^k$" where the gray scale voltages corresponding to the higher bits are represented as $VH_p$, where p is an integer in the range of 1 to $2^k-1$, and the gray scale voltages corresponding to the lower bits are represented as $VL_s$, where s is an integer in the range of 1 to $2^k-1$ and wherein the data line driving circuit supplies a selected gray scale voltage corresponding to the higher bits to the first data line or the second data line by selectively turning on one of $2^k$ switches disposed in correspondence with the gray scale voltages corresponding to the higher bits, and supplies a selected gray scale voltage corresponding to the lower bits to the second data line or the first data line by selectively turning on one of $2^k$ switches disposed in correspondence with the gray scale voltages corresponding to the lower bits.

5. The liquid crystal device according to claim 2, wherein the data line driving circuit generates $2^k$ gray scale voltages, which have equal voltage differences therebetween, corresponding to $2^k$ higher bits by performing a "$2^k-1$" dividing operation for a voltage corresponding to a gray scale range determined by the k higher bits and generates $2^{(k-1)}$ gray scale voltages corresponding to the lower bits which have equal voltage differences therebetween and satisfy voltage relationship of "$VL_s-VL_{(s-1)}=(VH_p-VH_{(p-1)})/2^{(k-1)}$" where the gray scale voltages corresponding to the higher bits are represented as $VH_p$, where p is an integer in the range of 1 to $2^k-1$, and the gray scale voltages corresponding to the lower bits are represented as $VL_s$, where s is an integer in the range of 1 to $2^k-1$ and wherein the data line driving circuit supplies a selected gray scale voltage corresponding to the higher bits to the first data line or the second data line by selectively turning on one of $2^{(k-1)}$ switches disposed in correspondence with the gray scale voltages corresponding to the higher bits, and supplies a selected gray scale voltage corresponding to the lower bits to the second data line or the first data line by selectively turning on one of $2^{(k-1)}$ switches disposed in correspondence with the gray scale voltages corresponding to the lower bits.

6. The liquid crystal device according to claim 3, wherein the data line driving circuit generates $2^{(k-1)}-1$ gray scale voltages, which have equal voltage differences therebetween, corresponding to k−1 higher bits by performing a "$2^{(k-1)}-1$" dividing operation for a voltage corresponding to a gray scale range determined by the k higher bits and generates $2^k$ gray scale voltages corresponding to the lower bits which have equal voltage differences therebetween and satisfy voltage relationship of "$VL_s-VL_{(s-1)}=(VH_p-VH_{(p-1)})/2^k$" where the gray scale voltages corresponding to the higher bits are represented as $VH_p$, where p is an integer in the range of 1 to $2^{(k-1}-1$, and the gray scale voltages corresponding to the lower bits are represented as $VL_s$, where s is an integer in the range of 1 to $2^k-1$, and wherein the data line driving circuit supplies a selected gray scale voltage corresponding to the higher bits to the first data line or the second data line by selectively turning on one of $2^{(k-1)}$ switches disposed in correspondence with the gray scale voltages corresponding to the higher bits, and supplies a selected gray scale voltage corresponding to the lower bits to the second data line or the first data line by selectively turning on one of $2^k$ switches disposed in correspondence with the gray scale voltages corresponding to the lower bits.

7. The liquid crystal device according to claim 1, wherein the data line driving circuit includes a first gray scale voltage generating circuit that generates the first gray scale voltage and a second gray scale voltage generating circuit that generates the second gray scale voltage.

8. The liquid crystal device according to claim 1, wherein the data line driving circuit alternately supplies the first gray scale voltage and the second gray scale voltage to the first data line and the second data line periodically.

9. The liquid crystal device according to claim 8, wherein the data line driving circuit alternately supplies the first gray scale voltage and the second gray scale voltage to the first data line and the second data line for each frame period.

10. A liquid crystal device comprising:

a plurality of pixels disposed in the shape of a matrix of n rows×m columns, where n and m are natural numbers equal to or larger than two;

n scanning lines;

2m data lines including pairs of a first data line and a second data line for each column of the plurality of pixels; and a data line driving circuit that generates a first gray scale voltage corresponding to higher bits acquired by dividing gray scale data of plural bits into the higher bits and lower bits and generates a second gray scale voltage corresponding to the lower bits, wherein each one of the plurality of pixels includes a first switching element and a second switching element which are controlled to be turned on or off by the scanning lines, a first pixel electrode to which the first or second gray scale voltage is alternatively supplied from the first data line through the first switching element, and a second pixel electrode to which the second or first gray scale voltage not supplied to the first pixel electrode is supplied from the second data line through the second switching element, and the data line driving circuit supplies the second gray scale voltages to the first and second data lines of pixels disposed in a (Q+1)-th, where Q is an arbitrary integer in the range of one to m−1, column in a case where the data line driving circuit supplies the first gray scale voltages to the first and second data lines of the pixels disposed in a Q-th column.

11. The liquid crystal device according to claim 1, wherein a withstand-voltage of a transistor relating to generation or path selection of the second gray scale voltage is set to be lower than that of a transistor relating to generation or path selection of the first gray scale voltage in the data line driving circuit.

12. The liquid crystal device according to claim 1, wherein a high level source voltage of a circuit generating the second gray scale voltage is set to be lower than that of a circuit generating the first gray scale voltage in the data line driving circuit.

13. An electronic apparatus including the liquid crystal device according to claim 1.

14. A data line driving circuit comprising:

a first gray scale voltage generating circuit that generates a plurality of first gray scale voltages corresponding to higher bits based on the higher bits acquired by dividing gray scale data of plural bits into the higher bits and lower bits, the plurality of the first gray scale voltages corresponding to k higher bits acquired by dividing the gray scale data of 2k, where k is a natural number equal to or larger than one, bits into the k higher bits and k lower bits;

a second gray scale voltage generating circuit that generates a plurality of second gray scale voltages corresponding to the lower bits based on the lower bits, the plurality of the second gray scale voltages corresponding to the k lower bits; and an output circuit including a switching circuit for selecting one from among the plurality of the first gray scale voltages and a switching circuit for selecting one from among the plurality of the second gray scale voltages.

15. A data line driving circuit according to claim 14, further comprising a conversion circuit that converts the number of gray scale data.

16. A method of driving a liquid crystal device having a plurality of pixels disposed in the shape of a matrix, the method comprising:

generating a first gray scale voltage on the basis of higher bits acquired by dividing gray scale data of plural bits into the higher bits and lower bits, corresponding to k higher bits acquired by dividing the gray scale data of 2k, where k is a natural number equal to or larger than one, bits into the k higher bits and k lower bits;

generating a second gray scale voltage on the basis of the lower bits, the second gray scale voltage corresponding to the k lower bits;

supplying a first gray scale voltage and a second gray scale voltage having a polarity opposite to that of the first gray scale voltage to a first liquid crystal electrode and a second liquid crystal electrode which are disposed in one pixel; and alternately supplying the first gray scale voltage and the second gray scale voltage to the first liquid crystal electrode and the second liquid crystal electrode periodically.

* * * * *